US007654730B2

(12) United States Patent
Marshall et al.

(10) Patent No.: US 7,654,730 B2
(45) Date of Patent: Feb. 2, 2010

(54) ERGONOMIC PAINT MIXER

(75) Inventors: Steven Marshall, Fort Mill, SC (US); Martin Miguel Salas, Charlotte, NC (US); James Howard Merritt, Jr., Charlotte, NC (US)

(73) Assignee: Ultrablend LLC, Charlotte, NC (US)

( * ) Notice: Subject to any disclaimer, the term of this patent is extended or adjusted under 35 U.S.C. 154(b) by 557 days.

(21) Appl. No.: 11/130,898

(22) Filed: May 17, 2005

(65) Prior Publication Data

US 2005/0195685 A1 Sep. 8, 2005

Related U.S. Application Data

(60) Provisional application No. 60/613,528, filed on Sep. 27, 2004.

(51) Int. Cl.
*B01F 9/04* (2006.01)

(52) U.S. Cl. ..... 366/217; 366/605

(58) Field of Classification Search ..... 366/211–217, 366/605, 220, 232

See application file for complete search history.

(56) References Cited

U.S. PATENT DOCUMENTS

| | | | | | |
|---|---|---|---|---|---|
| 1,997,400 | A | * | 4/1935 | Wysocki | 366/211 |
| 2,610,041 | A | * | 9/1952 | Stahl | 366/215 |
| 2,709,540 | A | | 5/1955 | Kenney | |
| 2,848,019 | A | | 8/1958 | Corbin et al. | |
| 3,670,785 | A | | 6/1972 | Heiss et al. | |
| 4,235,553 | A | * | 11/1980 | Gall | 366/208 |
| 4,314,653 | A | | 2/1982 | Sindoni | |
| 4,403,866 | A | | 9/1983 | Falcoff et al. | |
| 4,445,782 | A | * | 5/1984 | Sparrow, Jr. | 366/217 |
| 4,497,581 | A | | 2/1985 | Miller | |
| 4,705,083 | A | | 11/1987 | Rossetti | |
| 4,728,197 | A | * | 3/1988 | Reinhard | 366/219 |
| 5,197,802 | A | * | 3/1993 | Miller et al. | 366/217 |
| 5,383,163 | A | * | 1/1995 | Brunn | 366/217 |
| 5,442,997 | A | * | 8/1995 | Branz et al. | 99/330 |

(Continued)

FOREIGN PATENT DOCUMENTS

| | | |
|---|---|---|
| CA | 2 428 185 | 11/2003 |

(Continued)

OTHER PUBLICATIONS

Machine generated translation of DE 196 11 546 C1, generated Mar. 27, 2008.*

*Primary Examiner*—David L Sorkin
(74) *Attorney, Agent, or Firm*—Adams Intellectual Property Law

(57) ABSTRACT

An apparatus for mixing material in a container includes a platform mounted for simultaneous movement on at least two axes and for supporting a container containing material to be mixed. A motor can be operatively associated with the platform to move the platform on the two axes. A container holding assembly having a vertical extent can be carried by the platform, and is moveable between a closed position in which the holding assembly is positioned proximate the container to retain the container on the platform during mixing operations, and an open position in which the holding assembly is positioned away from the container so that the container can be removed from the platform without lifting the container over the vertical extent of the holding assembly. The platform can be contained within a housing having a low profile opening such that the container can be removed without elevating the container.

28 Claims, 39 Drawing Sheets

U.S. PATENT DOCUMENTS

| | | | | |
|---|---|---|---|---|
| 5,690,252 | A | 11/1997 | Oleksiewics et al. | |
| 5,711,601 | A * | 1/1998 | Thomas et al. | 366/209 |
| 5,746,510 | A * | 5/1998 | Mark et al. | 366/217 |
| 5,788,371 | A | 8/1998 | Neri et al. | |
| 5,799,820 | A | 9/1998 | Maas | |
| 6,193,410 | B1 | 2/2001 | Puckett, II | |
| 6,767,125 | B2 | 7/2004 | Midas et al. | |
| 6,767,126 | B2 | 7/2004 | Miller | |
| 7,165,879 | B2 * | 1/2007 | Midas et al. | 366/209 |
| 7,182,506 | B2 * | 2/2007 | Schulz et al. | 366/217 |
| 2003/0107949 | A1 | 6/2003 | Huckby et al. | |
| 2003/0142583 | A1 | 7/2003 | Santospag et al. | |
| 2003/0179646 | A1 | 9/2003 | Miller | |
| 2003/0214878 | A1 * | 11/2003 | Huckby | 366/217 |
| 2004/0085855 | A1 | 5/2004 | Midas et al. | |
| 2004/0141412 | A1 | 7/2004 | Midas et al. | |
| 2004/0208083 | A1 | 10/2004 | Armendariz et al. | |
| 2004/0240314 | A1 | 12/2004 | Armendariz et al. | |
| 2005/0002273 | A1 | 1/2005 | Huckby et al. | |
| 2005/0088910 | A1 | 4/2005 | Greco et al. | |
| 2006/0002229 | A1 * | 1/2006 | Schulz et al. | 366/217 |

FOREIGN PATENT DOCUMENTS

| | | |
|---|---|---|
| DE | 196 11 546 C1 * | 8/1997 |
| JP | 61-161128 | 7/1986 |
| JP | 8038871 | 2/1996 |

* cited by examiner

ERGONOMIC PAINT MIXER

This application claims priority to U.S. Provisional Ser. No. 60/613,528 filed on Sep. 27, 2004. This invention relates to an ergonomic paint mixer of the type used to evenly incorporate colorants into a base paint. Colorants may be introduced into the base paint in a number of ways, including automated dispensing means using a system such as applicant's TruBlend XT™ color dispenser. Once dispensed, the colorants must be homogeneously blended into the base paint so that all of the blended paint is exactly the same color. Failure to evenly blend the colorants into the base paint results in a defective product that is often returned for credit. Since the color is "custom" colored, the defective paint is typically discarded, resulting in wasted product and loss of profit on the sale of the product.

TECHNICAL FIELD AND BACKGROUND OF THE INVENTION

In home centers, paint stores, hardware stores and other paint retailing establishments, various devices are used to dispense and mix custom colors, including mixers such as applicant's TruMixCM™ vibrational mixer and applicant's TruMix™ vortex blenders.

A vortex blender is an apparatus that tips the paint container at an angle from the vertical and rotates the container about a non-vertical rotational axis while simultaneously rotating the container about a vertical axis in an orbital motion. These simultaneous motions effectively blend the colorants into the base paint. Advantages of this method include the relative lack of unbalanced movement, allowing large, heavy containers of paint to be blended without significant vibration, and without causing "walking" of the apparatus along its supporting surface during operation.

However, in present designs a 5-gallon (19 liter) bucket, which may weigh as much as 80 lbs. (36 kg), must be lifted a significant distance off of the floor and the bottom of the bucket tilted approximately 30 degrees in order for the bucket to slide down into the bucket-retaining well of the mixer. This can be difficult to accomplish under some circumstances.

This application discloses ergonomic improvements in a vortex blender to facilitate easier loading of the paint container into the blender and to more efficiently integrate the blender into an automated system including a roll conveyor for transferring paint containers from a blending machine to the vortex mixer.

While the disclosure of this application relates to mixing paint, the features disclosed in this application may have application in other fields of use, such as blending adhesives, mastics, surface finishes, food and beverage products and any other materials where efficient blending is required. Similarly, while this application discloses a vortex mixer utilizing gears and geared belts, the features disclosed have equal application to systems that may use conventional belt and pulley or other drive systems.

SUMMARY OF THE INVENTION

Therefore, it is an object of the invention to provide an ergonomic vortex paint mixer.

It is another object of the invention to provide an ergonomic vortex paint mixer that facilitates loading of paint containers into a vortex paint mixer.

It is another object of the invention to provide an ergonomic vortex paint mixer that permits loading of paint containers into a vortex paint mixer without tilting the container.

It is another object of the invention to provide an ergonomic mixer wherein the bucket handle retainer also provides security against inadvertent opening of the doors during operation.

It is another object of the invention to provide an ergonomic vortex paint mixer that is easily integrated into a system including a paint dispenser and a roll conveyor for conveying paint containers from the dispenser to the mixer.

These and other objects of the invention are achieved by providing a mixing apparatus having a platform mounted for simultaneous movement on at least two axes and for supporting a container containing a material to be mixed. A motor is operatively associated with the platform for moving the platform on the two axes. A container holding assembly having a vertical extent is carried by the platform, and is moveable between a closed position in which the holding assembly is positioned proximate the container to retain the container on the platform during movement of the platform, and an open position in which the holding assembly is positioned away from the container so that the container can be removed from the platform without lifting the container over the vertical extent of the holding assembly.

According to a preferred embodiment of the invention, the container is cylindrical and includes a lateral sidewall and at least one longitudinal end wall. The end wall is positioned on the platform, and the holding assembly includes an arcuate member conforming to the lateral sidewall of the container when in the closed position.

According to another preferred embodiment of the invention, the mixing apparatus includes a retainer for maintaining a handle on the container against the lateral sidewall of the container during movement of the container.

According to yet another preferred embodiment of the invention, a housing contains the platform and the holding assembly.

According to yet another preferred embodiment of the invention, the housing includes an opening for accessing the container positioned on the platform and a door for selectively covering the opening.

According to yet another preferred embodiment of the invention, the housing further includes a door lock for preventing opening of the housing door. The door lock is operatively connected to a solenoid so that the door lock is activated and prevents opening of the housing door when power to the mixing apparatus is disrupted.

According to yet another preferred embodiment of the invention, a loading table is positioned substantially in the same horizontal plane as the platform so that the container can be moved from the loading table to the platform without lifting the container.

According to yet another preferred embodiment of the invention, the loading table includes at least one roller for facilitating movement of the container on the loading table.

According to yet another preferred embodiment of the invention, a conveyor is positioned substantially on the same horizontal plane as the loading table for delivering the container to the loading table.

According to yet another preferred embodiment of the invention, the loading table is a part of the housing.

According to yet another preferred embodiment of the invention, the mixing apparatus includes a first bevel gear positioned eccentrically to the platform, and a second bevel gear mated with the first bevel gear and positioned concentrically to the platform. A pivot is mounted concentrically to the first bevel gear, and the platform is mounted eccentrically to the pivot. Rotation of the first bevel gear drives the second bevel gear and the pivot so that the platform rotates about at least two axes.

According to yet another preferred embodiment of the invention, the motor drives the rotation of the first bevel gear.

According to yet another preferred embodiment of the invention, the holding assembly includes a first door pivotally connected to a first connecting member mounted on the platform.

According to yet another preferred embodiment of the invention, a locking assembly is carried on the platform for engaging the first door when in the closed position so that the first door is maintained in a position proximate the container.

According to yet another preferred embodiment of the invention, the locking assembly includes a first locking element carried on the first door, and a complementary second locking element carried on the platform for mating with the first locking element, so that the first locking element engages the second locking element when the door assembly is in the closed position.

According to yet another preferred embodiment of the invention, the locking assembly includes a release for disengaging the first locking element and the second locking element.

According to yet another preferred embodiment of the invention, the first locking element includes a tapered plunger, and the second locking element includes a strike plate. The plunger latches with the strike plate when the door assembly is in the closed position.

According to yet another preferred embodiment of the invention, the first locking element includes a strike plate, and the second locking element includes a tapered plunger. The plunger latches with the strike plate when the door assembly is in the closed position.

According to yet another preferred embodiment of the invention, the holding assembly includes a second door pivotally connected to a second connecting member mounted on the platform.

According to yet another preferred embodiment of the invention, a first locking element is carried on the first door, and a complementary second locking element is carried on the second door for mating with the first locking element to lock the first door and the second door together, so that the first door and the second door can be maintained in a position proximate the container when in the closed position.

According to yet another preferred embodiment of the invention, a support frame is positioned on a base surface and supports the platform The support frame is moveable from a mixing position in which the platform is not substantially parallel with respect to the base surface, and a loading position in which the platform is elevated from the mixing position and substantially parallel to the base surface.

According to yet another preferred embodiment of the invention, the platform is positioned at about a thirty degree angle relative to the base surface when in the mixing position.

According to yet another preferred embodiment of the invention, the support frame includes an outer frame for positioning on the base surface, and an inner frame supporting the platform and pivotally mounted on the outer frame. The inner frame sits parallel to the outer frame when in the mixing position, and is elevated at an incline to the outer frame when in the loading position.

According to yet another preferred embodiment of the invention, the platform, holding assembly and support frame are contained within a housing. The housing has an opening for accessing the container positioned on the platform.

According to yet another preferred embodiment of the invention, the housing includes a door for opening and closing the opening. The door is operatively associated with the support frame such that the support frame moves to the loading position when the door is opened and moves to the mixing position when the door is closed.

According to yet another preferred embodiment of the invention, the housing includes a locking mechanism operatively connected to a power supply for the mixing apparatus such that the locking mechanism prevents opening of the housing door when the power supply is disrupted.

According to yet another preferred embodiment of the invention, the mixing apparatus includes a platform having a substantially horizontal loading position for receiving and supporting a container containing a material to be mixed, and a housing containing the platform. The housing has an opening with a bottom extent no higher than the loading position of the platform so that the container can be removed from the housing without elevating the container.

According to yet another preferred embodiment of the invention, the housing includes a sidewall defining the bottom extent of the opening in the housing. The sidewall extends no higher than the loading position of the platform so that the container can be removed from the housing without lifting the container over the sidewall.

According to yet another preferred embodiment of the invention, the mixing apparatus includes a platform having a substantially horizontal loading position for receiving and supporting a container containing a material to be mixed, and an actuator assembly operatively associated with the platform for moving the platform on at least two axes, the actuator assembly includes a first bevel gear positioned eccentrically to the platform, and a second bevel gear mated with the first bevel gear and positioned concentrically to the platform. A pivot is mounted concentrically to the first bevel gear, and the platform is mounted eccentrically to the pivot. Rotation of the first bevel gear drives the second bevel gear and the pivot, so that the platform rotates about the at least two axes.

A container holding assembly having a vertical extent is carried by the platform. The holding assembly is moveable between a closed position in which the holding assembly is positioned proximate the container to retain the container on the platform during movement of the platform, and an open position in which the holding assembly is positioned away from the container so that the container can be removed from the platform without lifting the container over the vertical extent of the holding assembly. A housing contains the platform, actuator assembly and holding assembly. The housing has an opening having a bottom extent no higher than the loading position of the platform for accessing the container on the platform so that the container can be removed from the housing without elevating the container.

According to yet another preferred embodiment of the invention, a motor is operatively associated with the actuator assembly and drives the rotation of the first bevel gear.

According to yet another preferred embodiment of the invention, the housing includes a door lock for preventing opening of the housing door. The door lock is operatively connected to a solenoid such that the door lock is disabled and the housing door can be opened when power is supplied to the mixing apparatus. The door lock is activated and prevents opening of the housing door when power to the mixing apparatus is disrupted.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
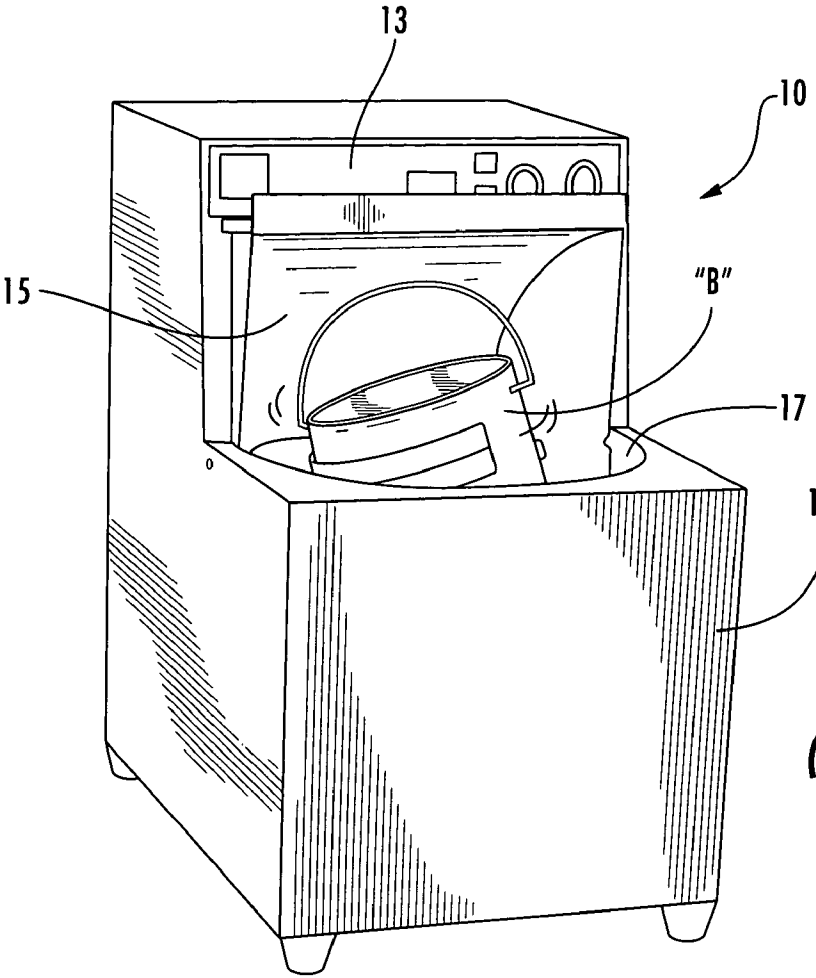
FIG. 1 (PRIOR ART)
FIG. 1 is a perspective view of a vortex mixer according to a preferred embodiment of the invention.

Referring now specifically to the drawings, a prior art paint mixer on which the present invention is based is illustrated in FIG. 1 and shown generally at reference numeral 10. The mixer 10 includes a housing 11, a control panel 13 and a door 15, shown in its open position. The mixer 10 includes a well 17 into which any suitable container, for example, a bucket "B", is positioned for mixing of its contents.

Further description takes place with reference to FIGS. 2-15, which collectively disclose two embodiments of the invention, both of which include two opposed door assemblies. The opposed door assemblies ensure access to the bucket "B" without regard to the position of the bucket when the mixer is stopped. The housing and related exterior components have been removed for clarity in FIGS. 2-15 but, in general, the exterior appearance is similar to the appearance of the prior art mixer 10 shown in FIG. 1.

Figure 2:
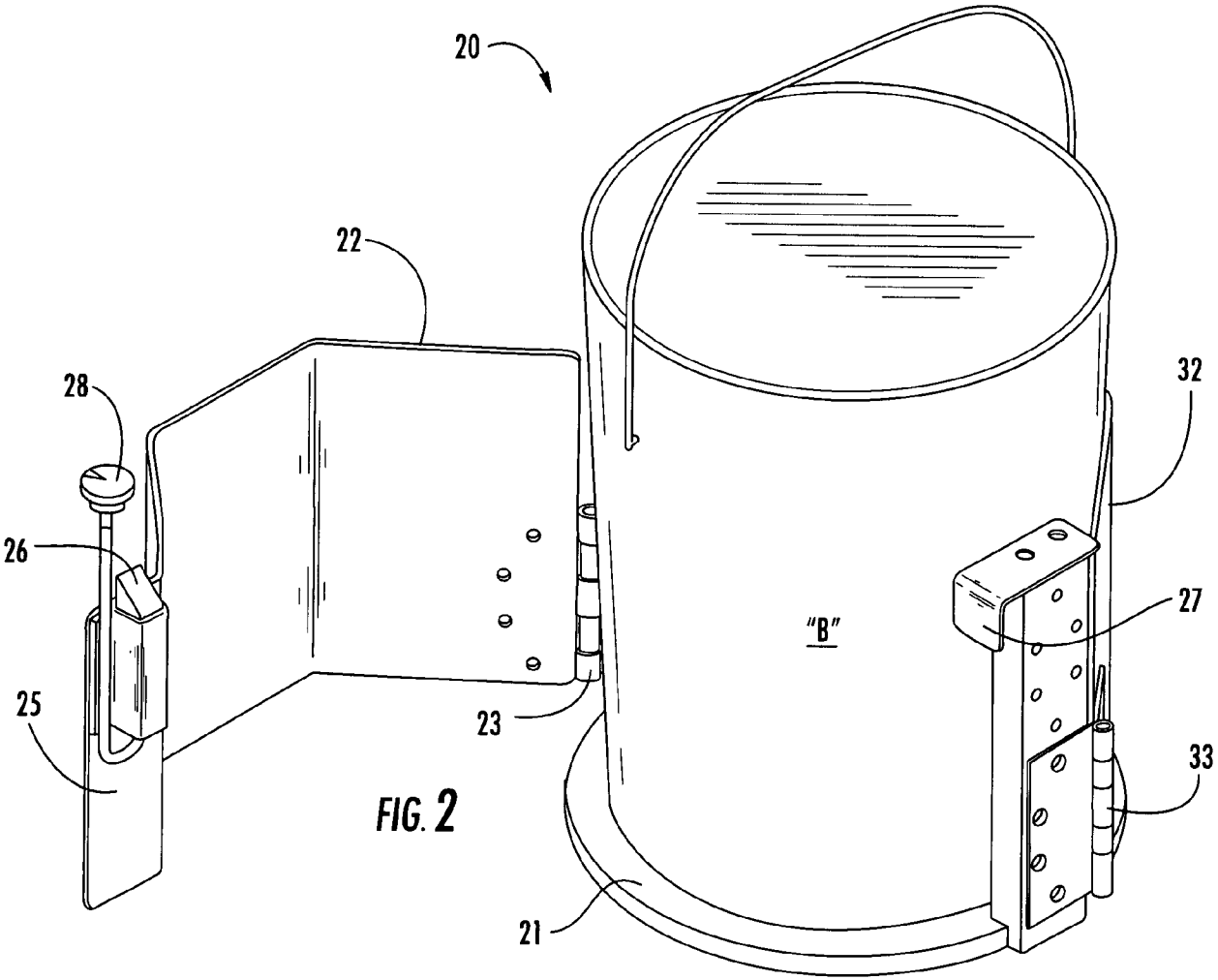
FIG. 2 is a fragmentary perspective view of one preferred embodiment of a door used to permit introduction and locking of the container into the mixer.
Figure 3:
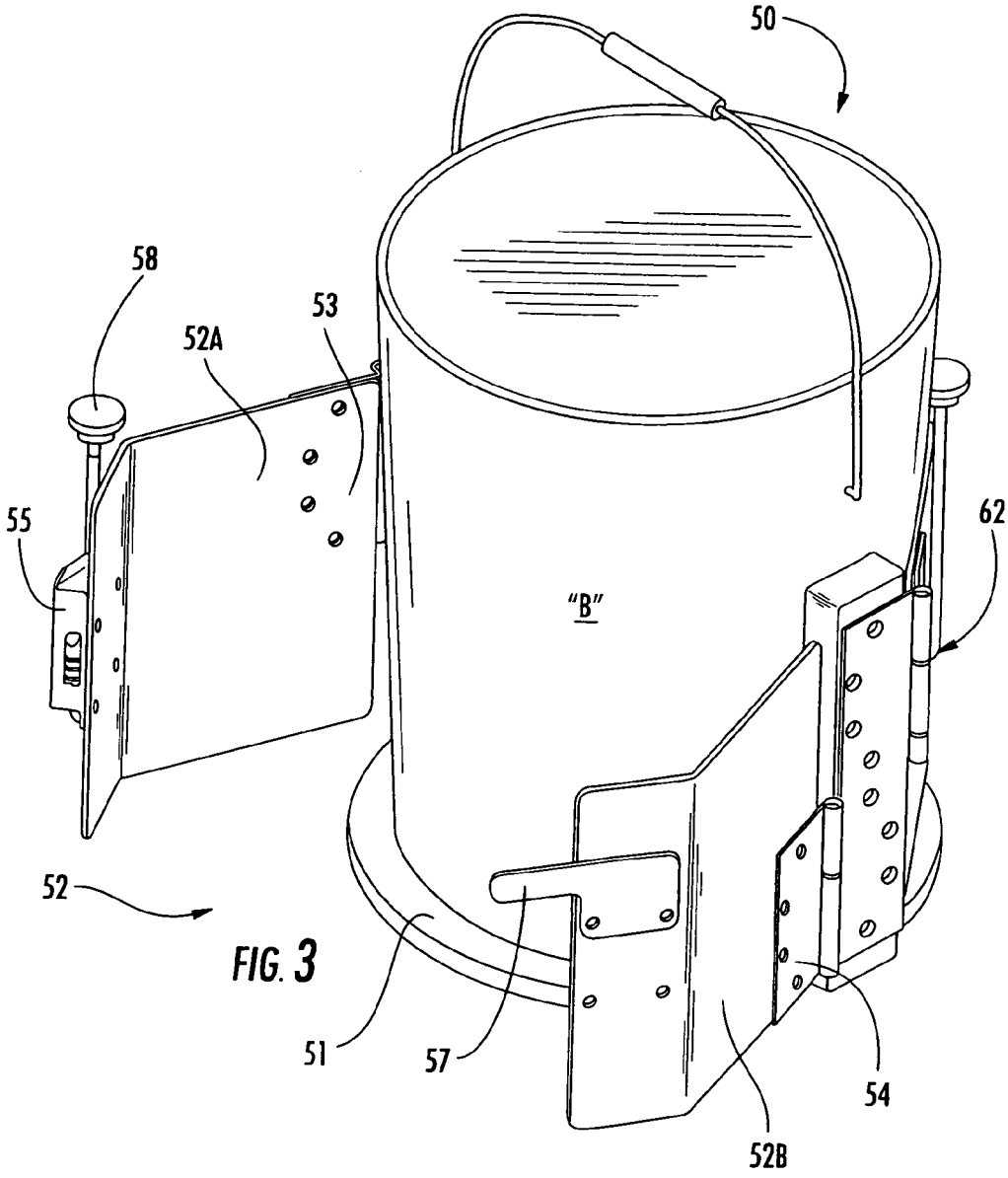
FIG. 3 is a fragmentary perspective view of another preferred embodiment of a door used to permit introduction and locking of the container into the mixer.
Figure 4:
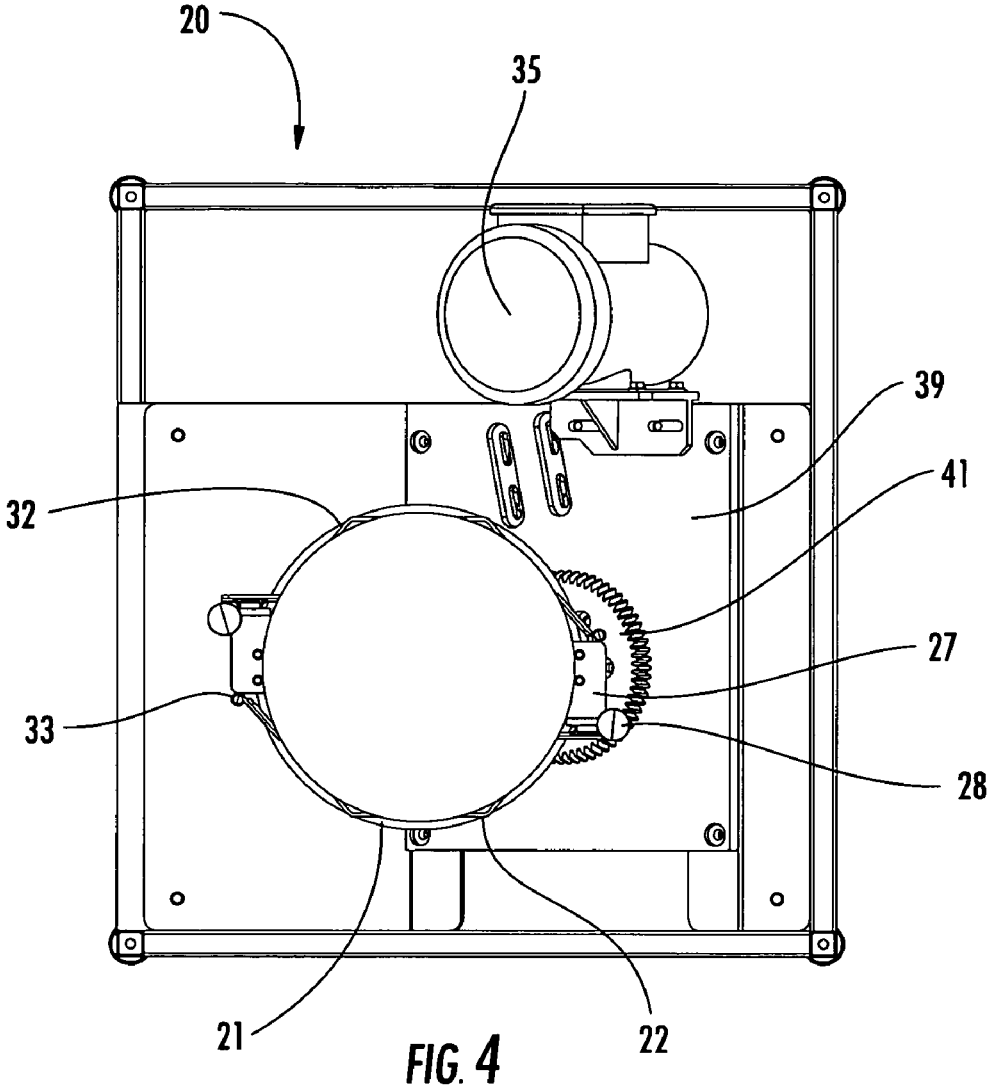
FIG. 4 is a top plan view of the mixer, showing the container support platform in a horizontal, loading position.
Figure 5:
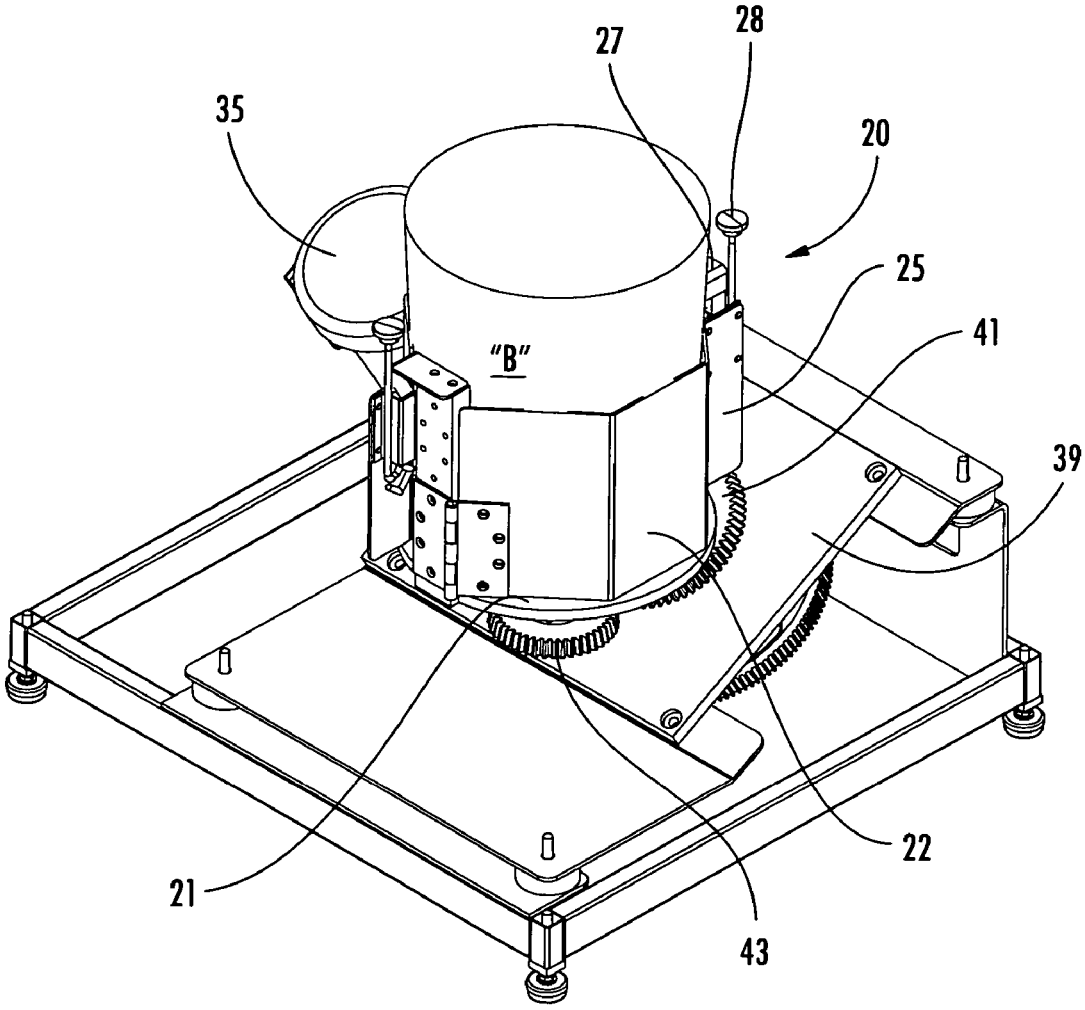
FIG. 5 is a fragmentary perspective view of the mixer, showing the container support platform in horizontal, loading position also shown in FIG. 4.
Figure 6:
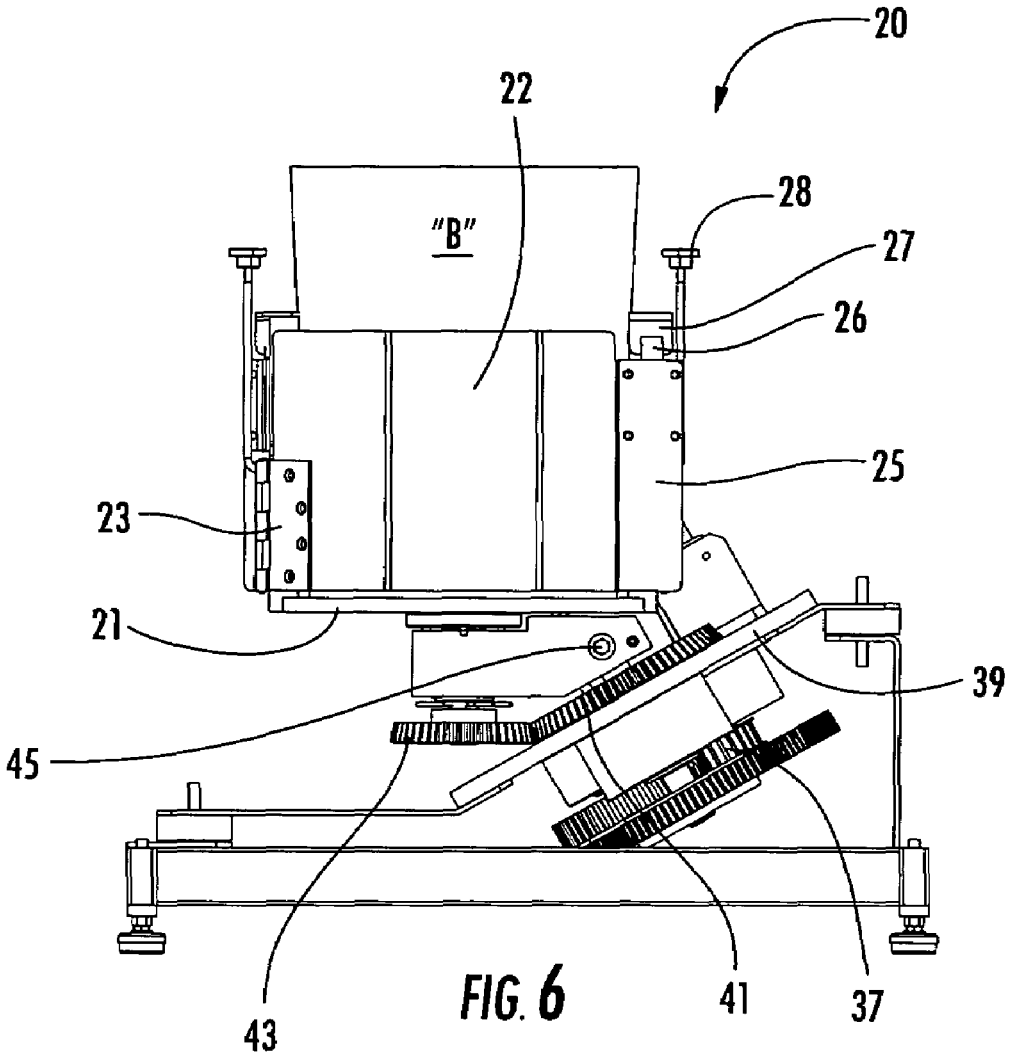
FIG. 6 is a fragmentary side elevation of the mixer, showing the container support platform in horizontal, loading position also shown in FIG. 5.
Figure 7:
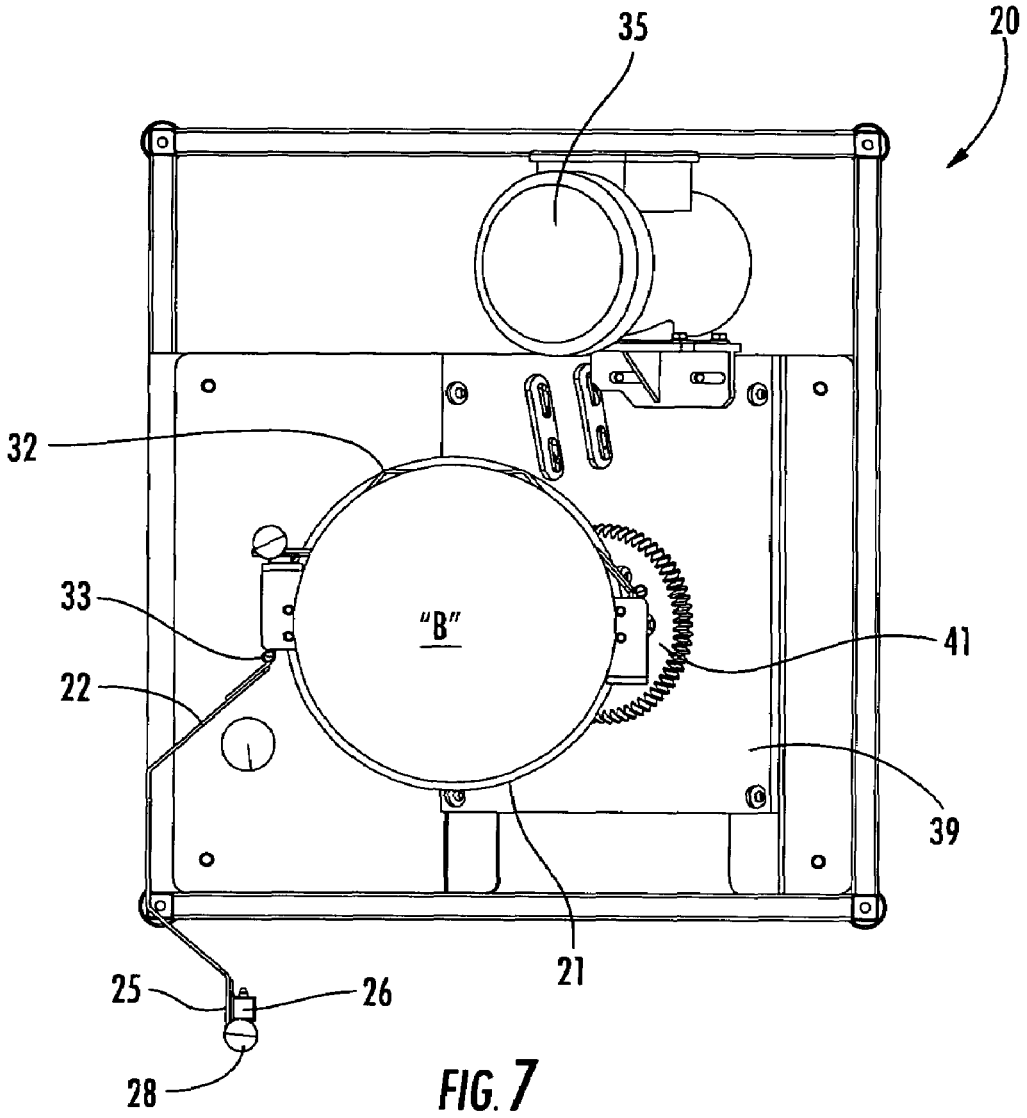
FIG. 7 is a top plan view of the mixer shown in FIG. 6 with the door in an open, loading position.
Figure 8:
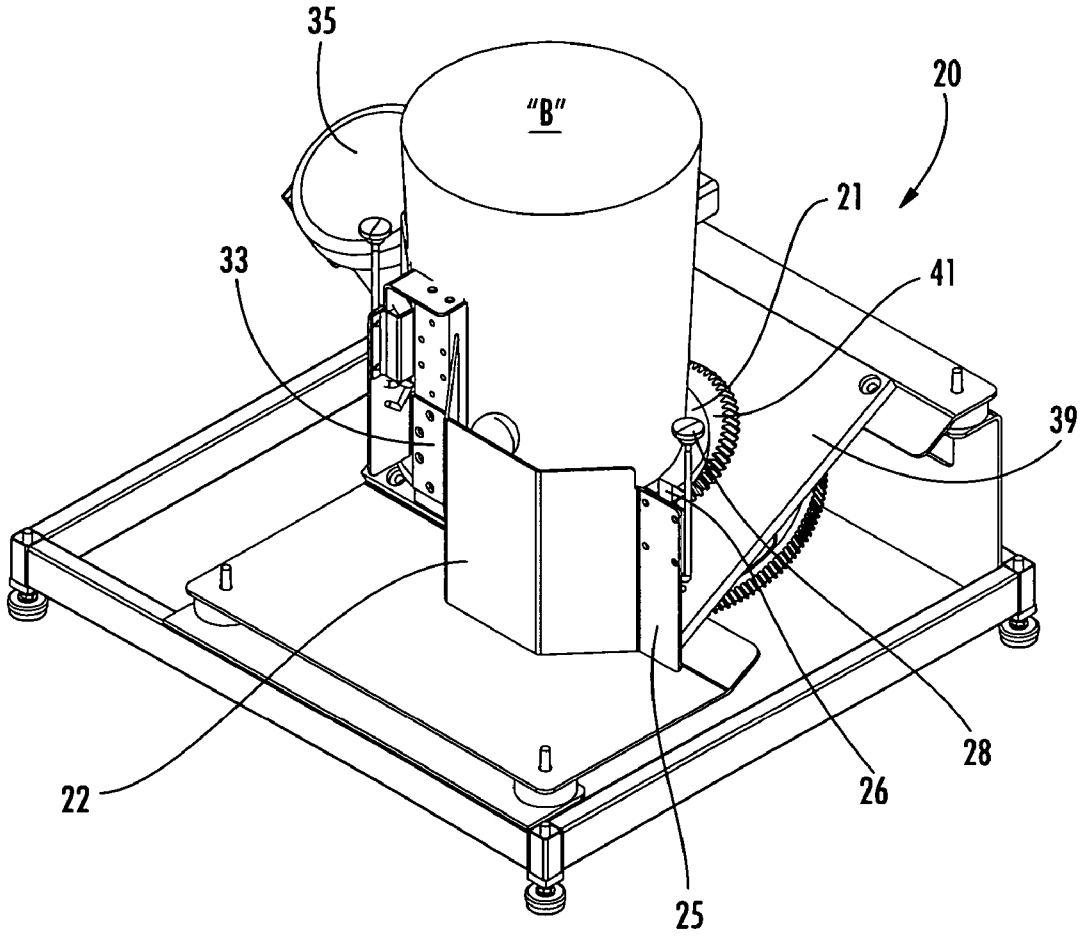
FIG. 8 is a perspective view of the mixer shown in FIG. 7.
Figure 9:
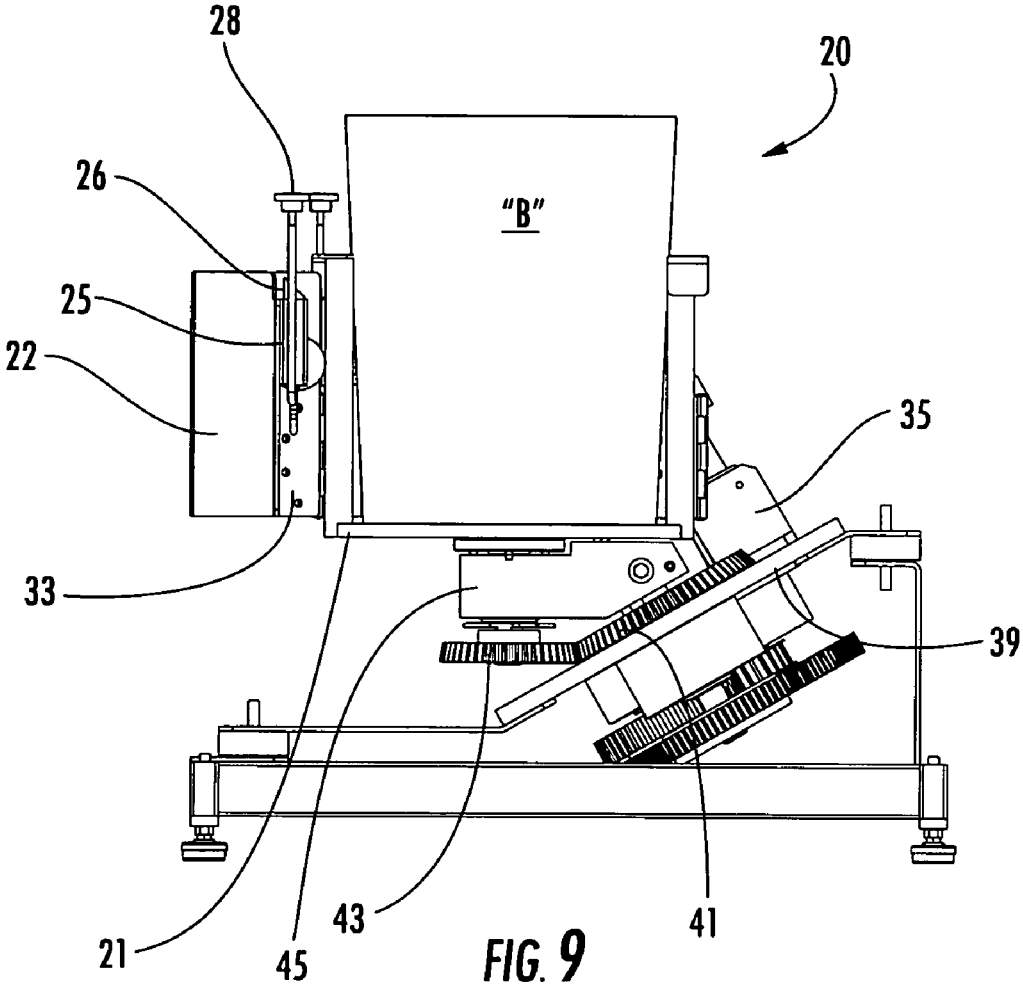
FIG. 9 is a side elevation of the mixer with the door in the open position for loading.
Figure 10:
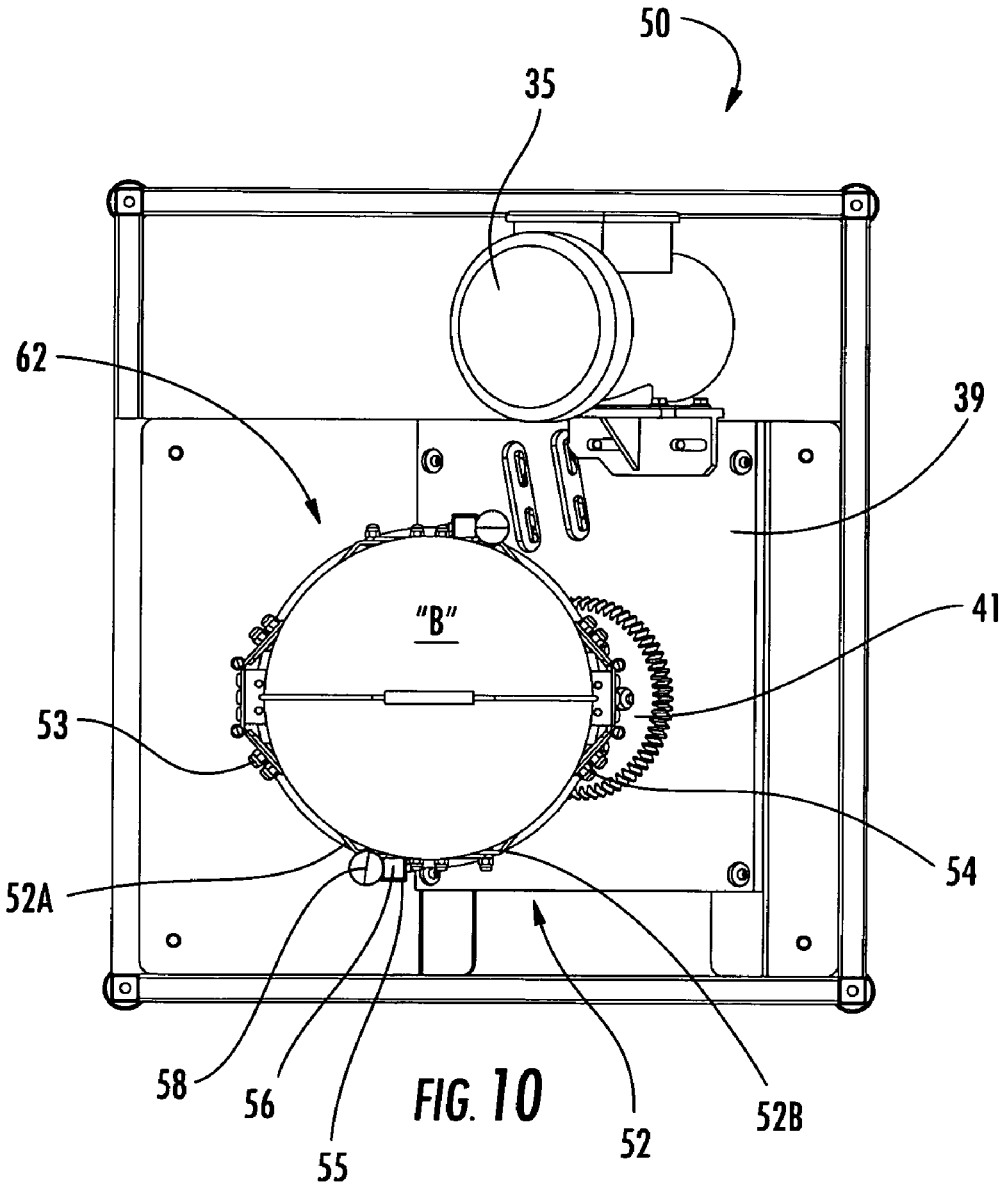
FIG. 10 is a top plan view of the mixer with the door closed.
Figure 11:
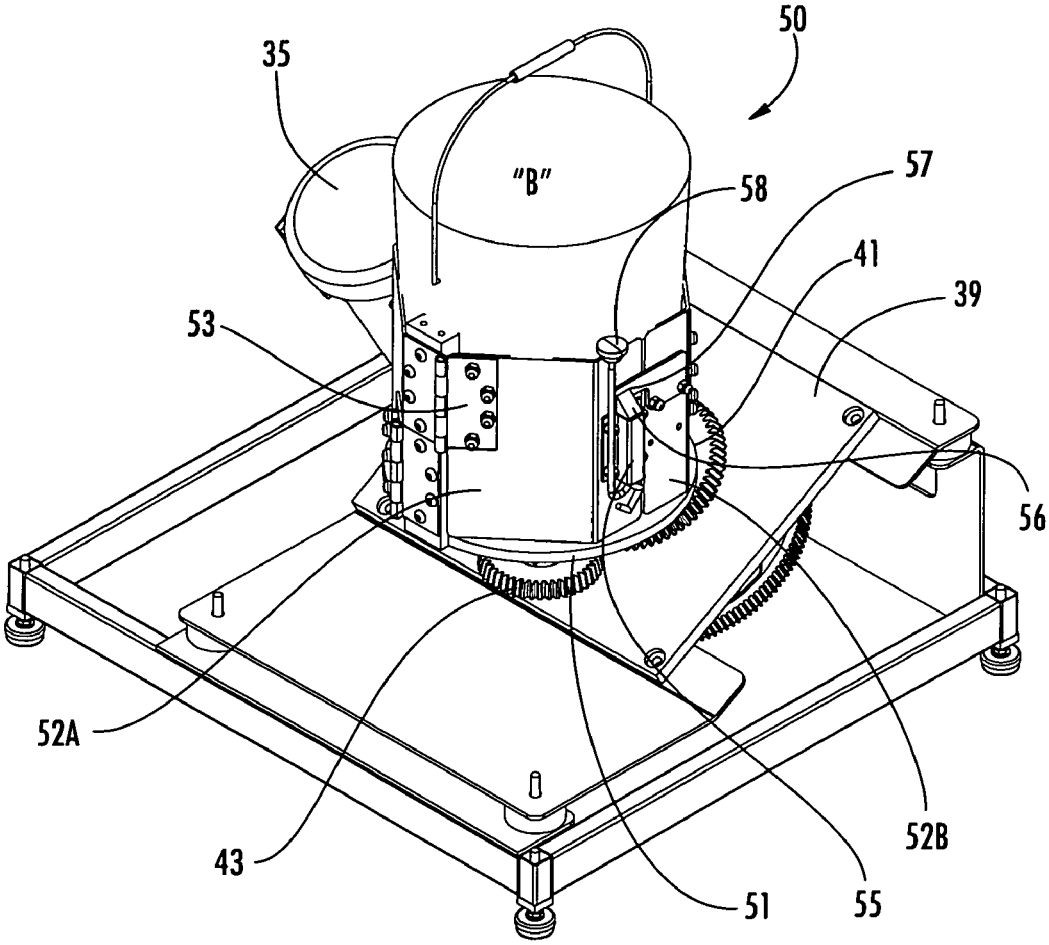
FIG. 11 is a fragmentary perspective view of the mixer shown in FIG. 3 with the door in the closed position.
Figure 12:
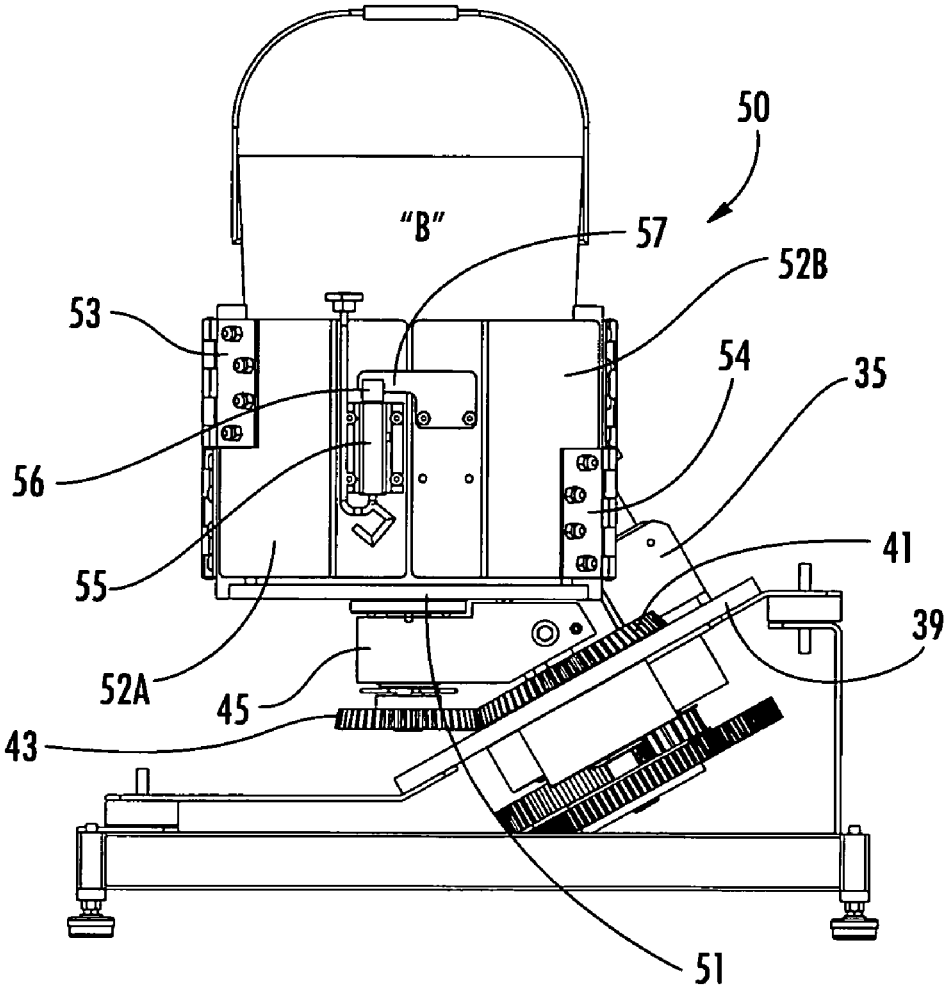
FIG. 12 is a side elevation of the mixer shown in FIG. 11.
Figure 13:
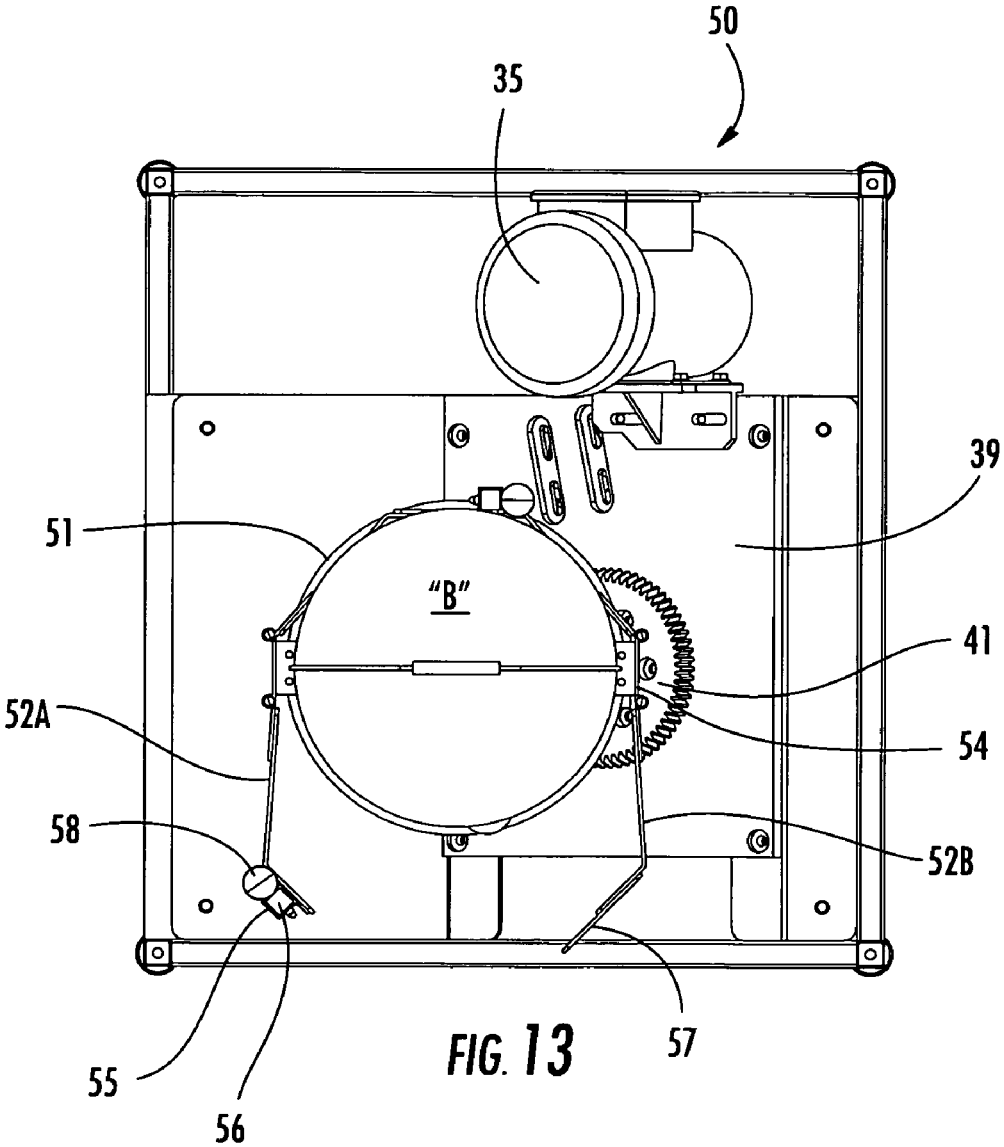
FIG. 13 is a top plan view of the mixer shown in FIG. 11 with the door in the open position.
Figure 14:
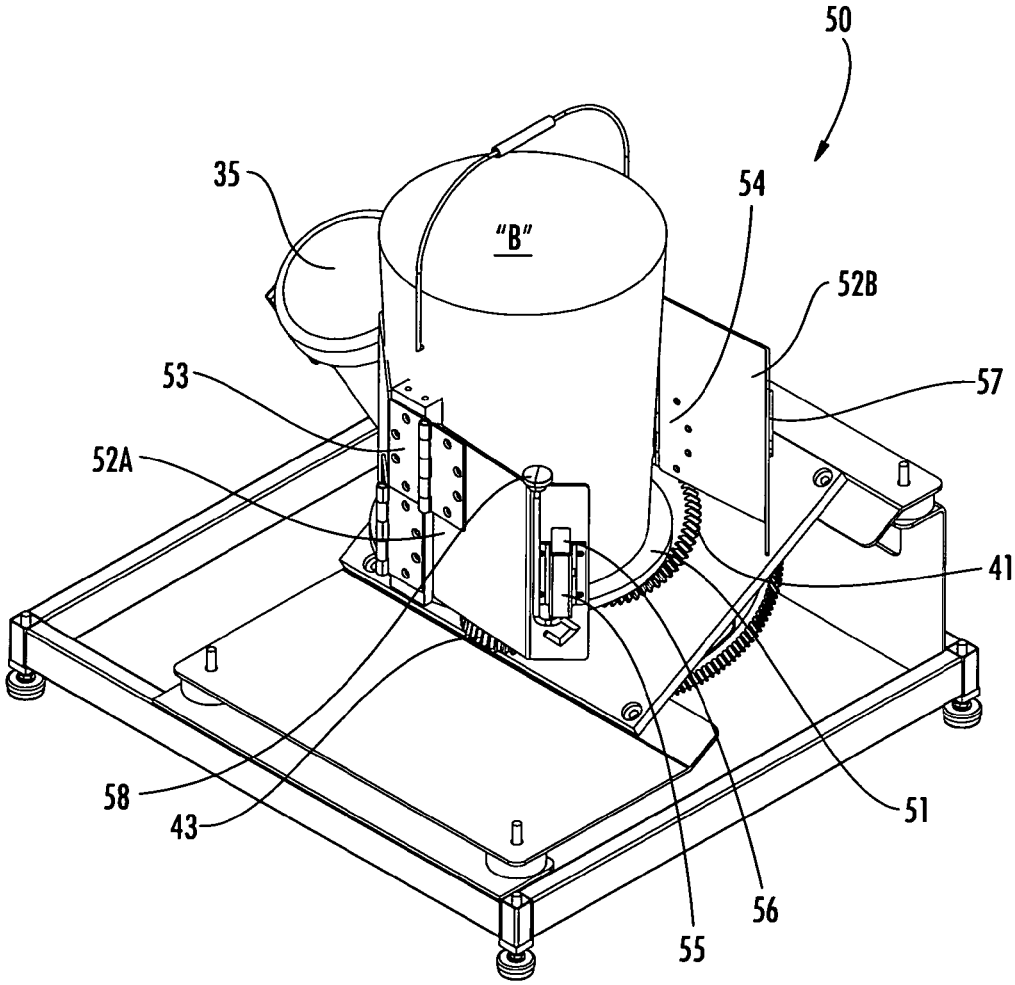
FIG. 14 is a fragmentary perspective view of the mixer shown in FIG. 13.
Figure 15:
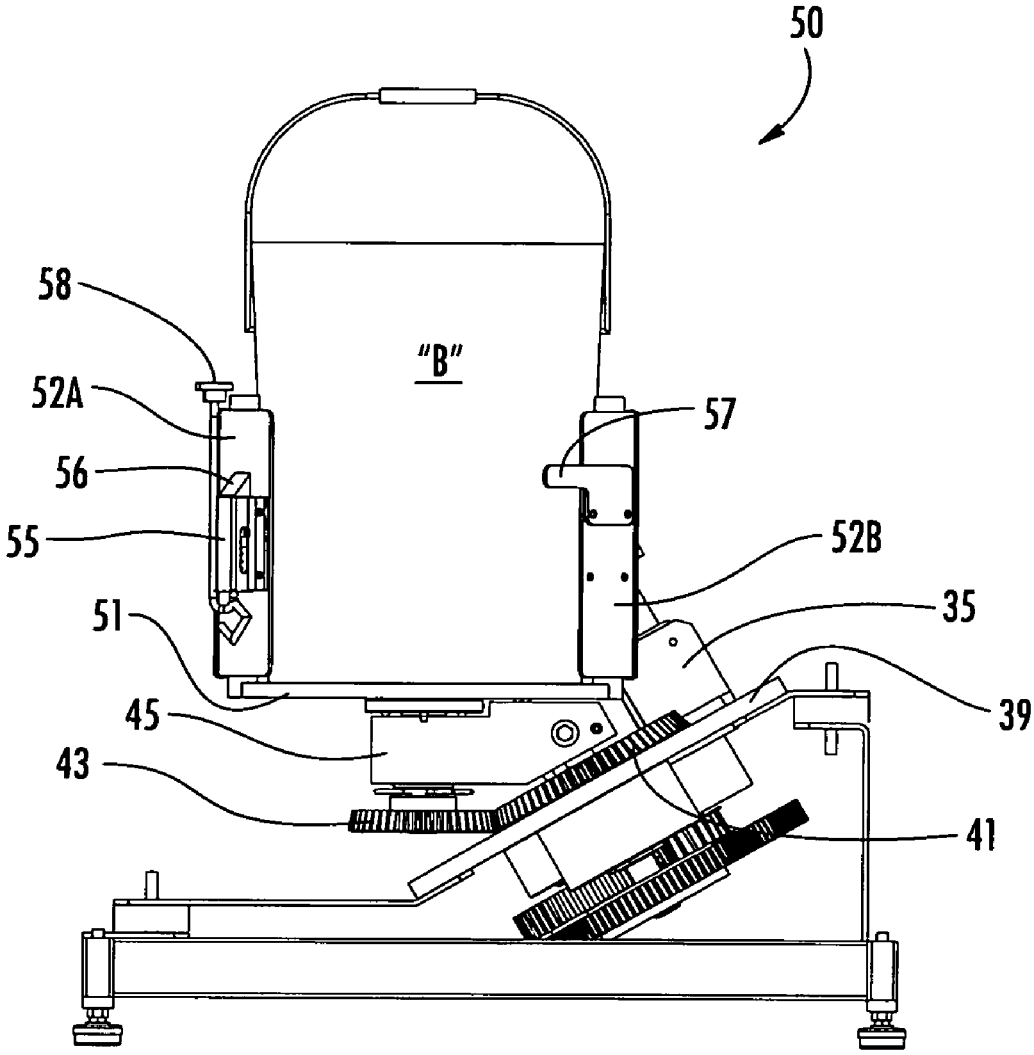
FIG. 15 is a side elevation of the mixer shown in FIG. 14, with the door in the open position.

Referring now to FIG. 2, a vortex mixer 20 is sized to accommodate a container, such as a paint bucket "B", and includes a platform 21 for supporting the bucket "B". The mixer 20 includes a holding assembly having a vertical extent for maintaining the bucket "B" on the platform 21, such as two doors 22 and 32 carried on the platform 21. The doors 22 and 32 are mounted by respective hinges 23, 33. Although the mixer 20 is shown to have two doors 22, 32, alternatively the mixer 20 can include just one door, or more than two doors. Furthermore, the holding assembly can encompass structures other than doors 22, 32. As used throughout this application, "vertical extent" refers generally to any structure that in whole or in part extends above the platform 21 in any respect, and does not require the structure to extend upward at any particular angle.

Door 22 has mounted thereon a latch assembly 25 that includes a tapered plunger 26 that engages and latches with a strike plate 27. A latch release handle 28 permits the latch assembly 25 to be disengaged by pressing down the handle 28, thereby releasing the plunger 26 from engagement with the strike plate 27.

Door 32 is operated by an identical mechanism. See, for example, FIG. 7.

As is shown in FIGS. 4, 5, 6, 7, 8 and 9, platform 21 is mounted for movement at an angle from the vertical and rotates the bucket "B" about a non-vertical rotational axis while simultaneously rotating the bucket "B" about a vertical axis in an orbital motion. The platform 21 is rotated by a motor 35 through a gear and gear belt train 37. The motor 35 can be of any horsepower sufficient to rotate the platform 21, and can be run on any suitable energy source, such as electricity, gasoline or battery power. Preferably, the motor 35 is ¾ horsepower/8 amp/1800 rpm. The motor 35 and the gear and gear belt train 37 are mounted on a support 39 at a 30 degree angle and drive a bevel gear 41 mounted on the top side of the support 39. The bevel gear 41 drives a mated beveled platform gear 43.

The platform 21 is mounted for rotation on a pivot 45 mounted concentrically with the bevel gear 41 and eccentric to the vertical axis of the platform 21. The beveled platform gear 43 is concentric and in axial alignment with the vertical axis of the platform 21.

Rotation of the bevel gear 41 thus drives the platform gear 43 and the pivot 45, causing the platform 21 to which the pivot 45 is mounted to rotate simultaneously about two axes, one vertical, and one at a 30 degree angle to vertical.

An alternative door assembly 50 is shown in FIGS. 3, 10, 11, 12, 13, 14 and 15. A platform 51 for supporting a bucket "B" is provided on which are mounted two sets of doors 52 and 62. Doors 52A and 52B are mounted by respective hinges 53, 54. Door 52A includes a latch assembly 55 that includes a tapered plunger 56 (see FIGS. 14 and 15) that engages and latches with a locking finger 57 that extends outwardly from the door 52B. A latch release handle 58 permits the latch assembly 55 to be disengaged by pressing down the handle 58, thereby releasing the plunger 56 from engagement with locking finger 57.

Door 62 is operated in an identical manner. See, for example, FIGS. 13, 14 and 15.

With either embodiment, the doors are closed around the bucket "B" and the handle of the bucket "B" is lowered down to the side of the bucket "B" outside of the closed doors. To prevent the handle from flying outwardly due to centrifugal force during operation, a heavy elastic retaining cord (not shown) similar to a bungee cord is extended completely around the closed doors and the handle of the bucket "B" and locked into position with hooks on opposite ends. This feature not only retains the handle in a fixed position against the closed doors, but should the doors either not be properly latched prior to operation, or come unlatched during operation, the retaining cord will both prevent movement of the handle and maintain the doors in their closed position even if unlatched.

The ability of the mixer 10 to be loaded with the platform 21 in an upright position and with the doors 22, 32 or 52A, 52B open provides a low profile, ergonomic apparatus whereby the bucket "B" does not need to be lifted as high off of the floor, and does not need to be lifted over the sidewalls of a well, such as the well 17 in FIG. 1.

Another preferred embodiment of the invention is illustrated in FIGS. 16-19, and shown generally at reference numeral 70. The mixer 70 includes a platform 71 for supporting a container having a material to be mixed such as the paint bucket "B." The mixer 70 includes a holding assembly having a vertical extent for maintaining the bucket "B" on the platform 71, such as a pair of doors 72 and 82 carried on the platform 71.

Figure 17:
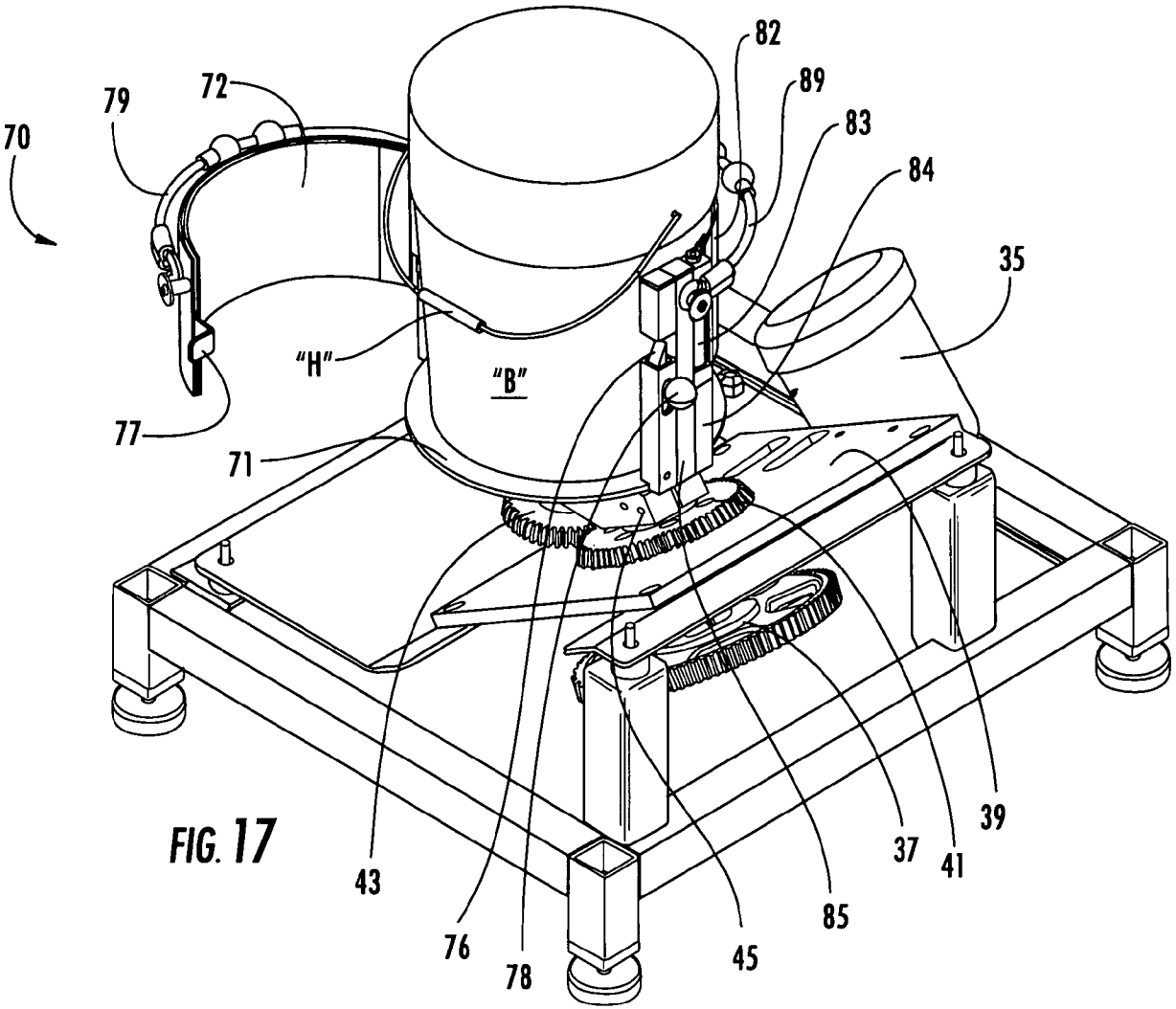
FIG. 17 is a perspective view of the mixer of FIG. 16.
Figure 18:
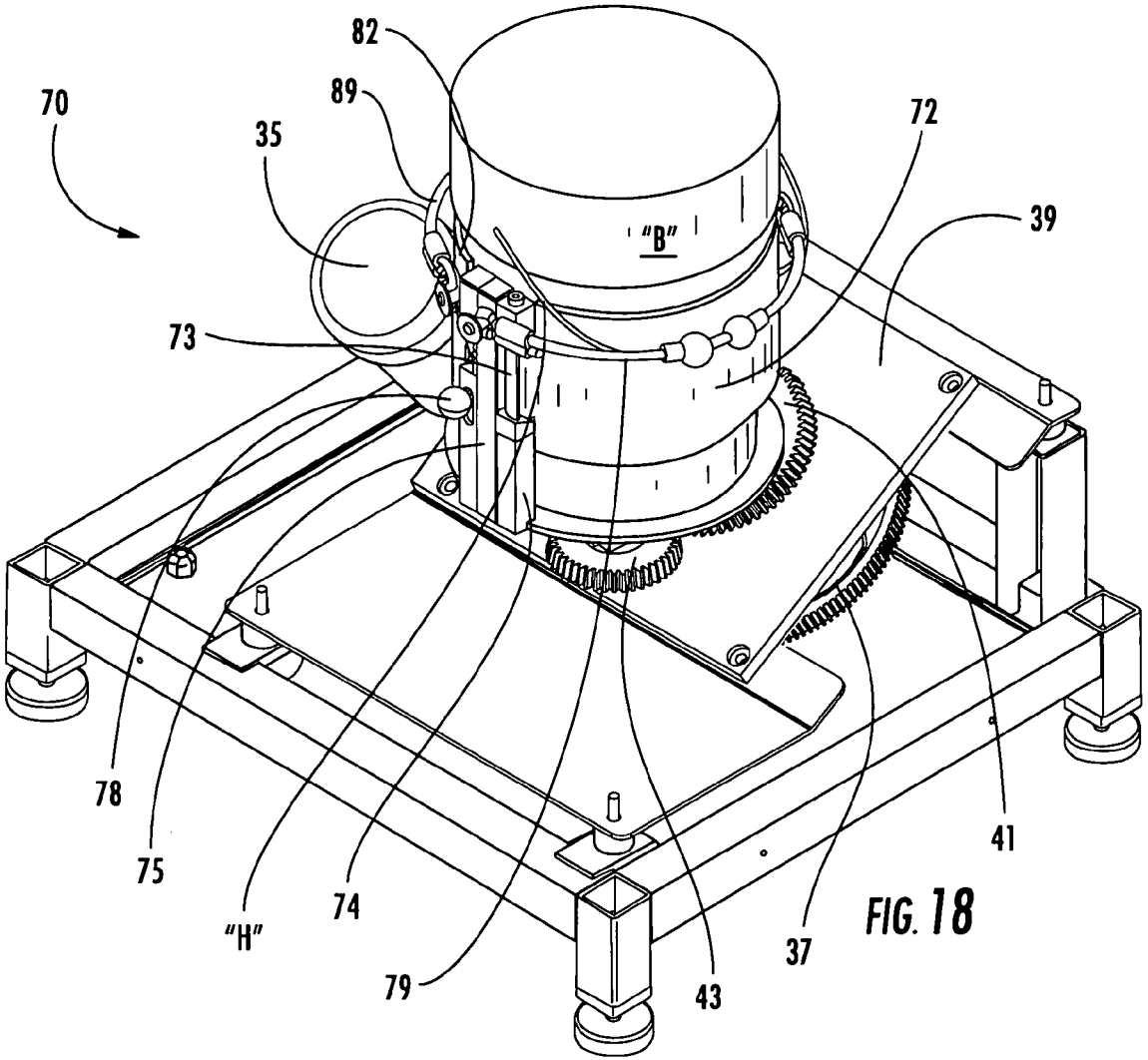
FIG. 18 is another perspective view of the mixer of FIG. 16.
Figure 19:
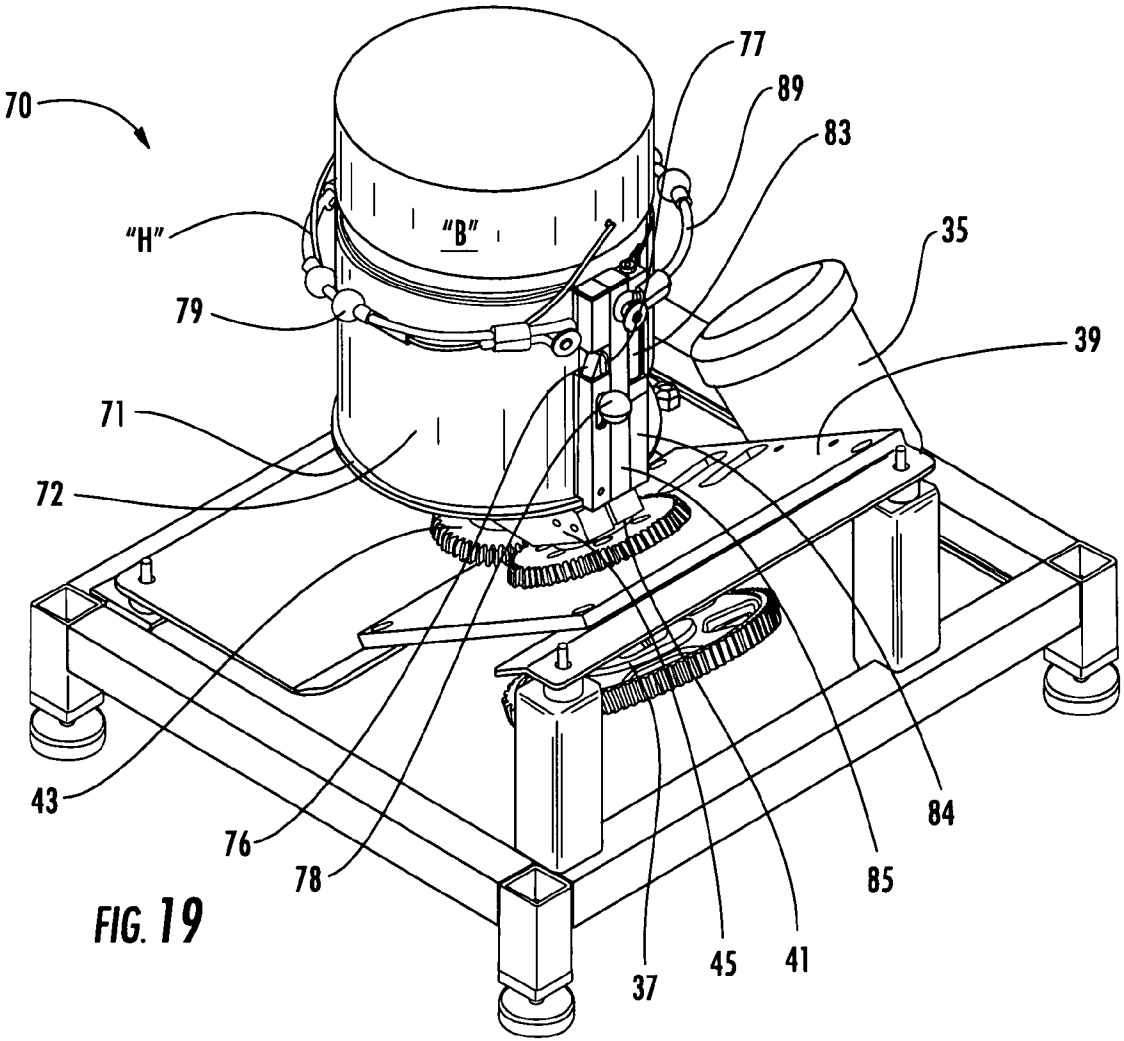
FIG. 19 is yet another perspective view of the mixer of FIG. 16.

As shown in FIGS. 16-19, the doors 72, 82 can have an arcuate shape conforming to the curvature of the lateral sidewall of bucket "B." The doors 72, 82 have a gradual curvature, rather than the sharp angled shape of the embodiments described above. The doors 72, 82 are mounted by respective hinges 73, 83 to posts 74, 84, respectively, that extend upwardly from the platform 71. The pivotal connection of the doors 72, 82 allows for each door 72, 82 to be opened and closed. For example, FIG. 19 shows the doors 72, 82 in a closed position in which the doors 72, 82 maintain the bucket "B" securely on platform 71 during mixing operations. When mixing operations are complete, door 72 and/or door 82 can be pivoted to an open position, shown in FIGS. 17 and 18 with respect to door 72, to allow for ergonomic removal of the bucket "B" from the platform. As such, the user does not have to lift the bucket "B" over the doors 72, 82, resulting in a more efficient and ergonomic design.

Figure 16:
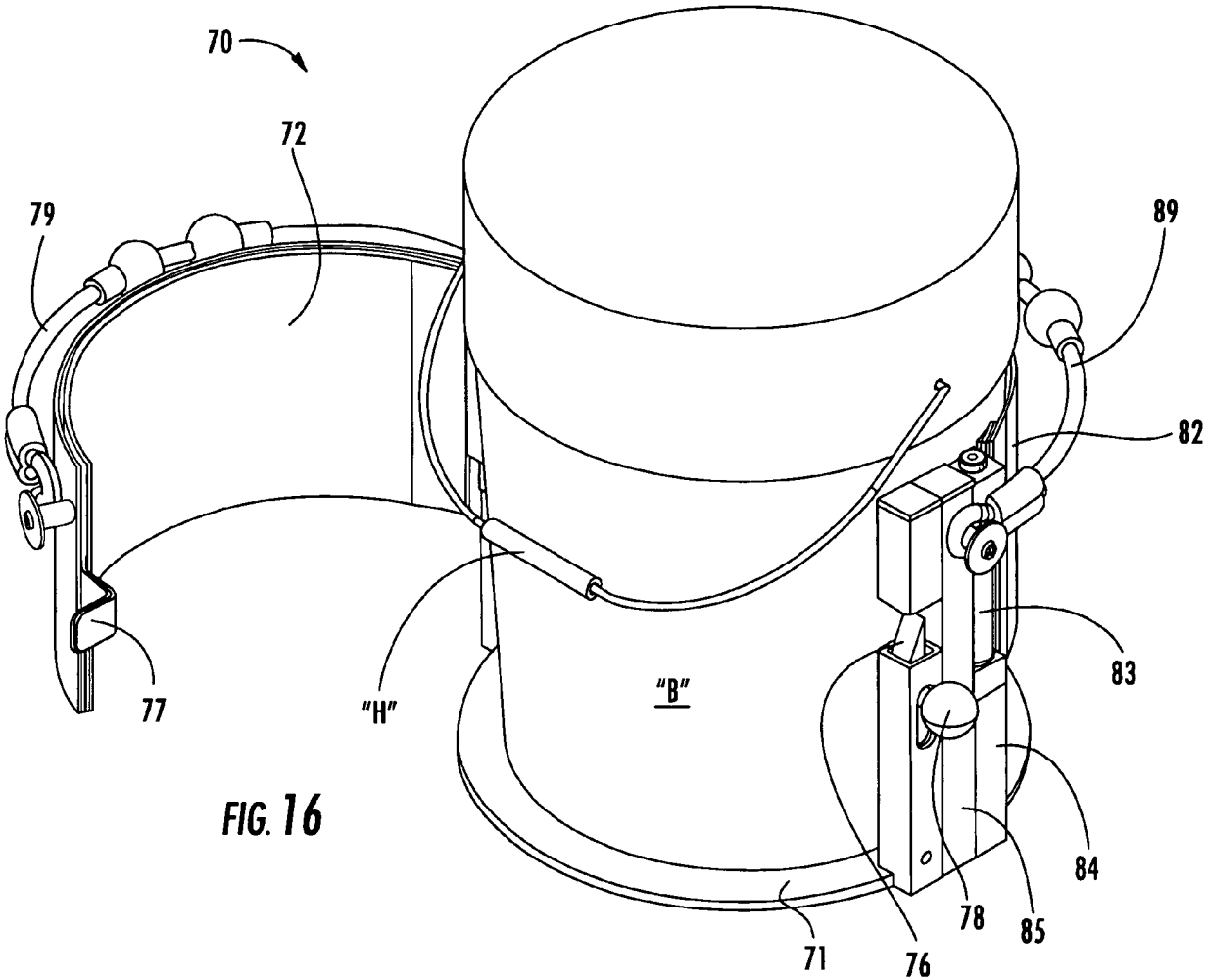
FIG. 16 is a partial perspective view of a mixer according to another preferred embodiment of the invention.

As shown in FIG. 16, the door 72 has a latch assembly that includes a strike plate 77 mounted at one end of the door 72 that engages and latches with a plunger 76 mounted on the platform 71. When the strike plate 77 engages the plunger 76, the door 72 is locked into a closed position, as shown in FIG. 18. A latch release handle 78 communicates with the plunger 76. The strike plate 77 can be disengaged from the plunger 76 by pressing down on the handle 78, thereby releasing the strike plate 77 from engagement with the plunger 76 and allowing the door 72 to pivot to an open position, as shown in FIGS. 16 and 17. The other door 82 has an identical latch assembly.

The mixer 70 can also include retainer cords 79, 89 mounted on the doors 72, 82, respectively, as shown in FIGS. 17-19. The retainer cords 79, 89 prevent the bucket handle "H" from flying outwardly due to centrifugal force during mixing operations. The retainer cords 79, 89 extend around the closed doors 72, 82 and the bucket handle "H". Retainer cord 79 is mounted on door 72 and a post 75 extending upward from the platform 71. Retainer cord 89 is mounted on door 82 and a post 85 extending upward from the platform 71. The posts 75, 85 are located approximately 180 degrees from each other on platform 71.

The platform 71 is mounted for movement at an angle from the vertical and rotates the bucket "B" about a vertical axis in an orbital motion. The mixer 70 has an actuating mechanism in which the platform 71 is rotated by motor 35 through a gear gear belt train 37. The motor 35 and the gear and gear belt train 37 are mounted on a support 39, preferably at a 30 degree angle, and drive a bevel gear 41 mounted on the top side of the support 39. The bevel gear 41 drives a mated beveled platform gear 43.

The platform 71 is mounted for rotation on pivot 45 mounted concentrically with the bevel gear 41 and eccentric to the vertical axis of the platform 71. The beveled platform gear 43 is concentric and in axial alignment with the vertical axis of the platform 71.

Rotation of the bevel gear 41 thus drives the platform gear 43 and the pivot 45, causing the platform 71 to which the pivot 45 is mounted to rotate simultaneously about two axes, one vertical, and one at a 30 degree angle to vertical, as illustrated in FIGS. 20-25. As shown in FIGS. 20-26, the mixer 70 can include a housing 120 containing the platform 71. The housing 120 includes a pair of rollers 124*a*, 124*b* for facilitating movement of the bucket "B" onto the platform 71.

Figure 20:
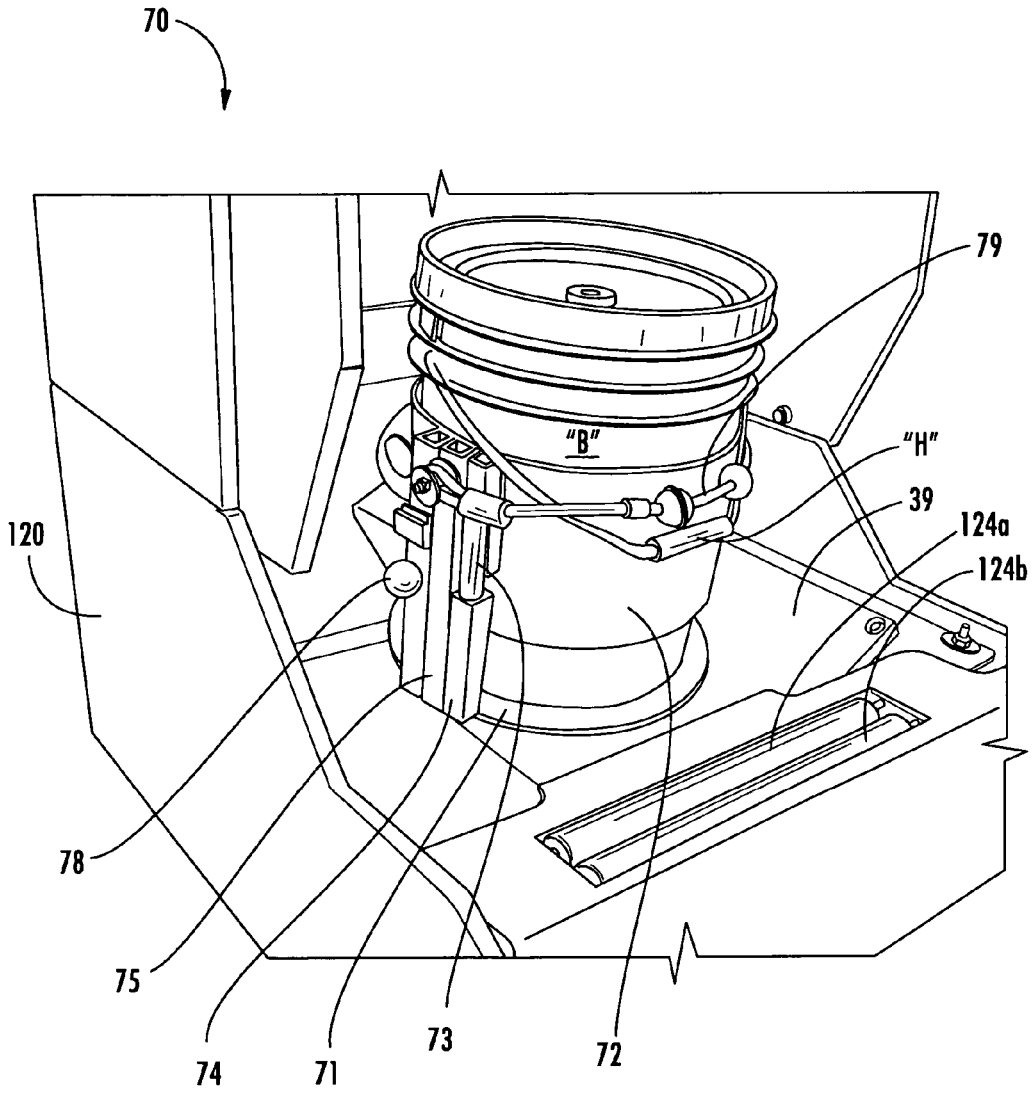
FIGS. 20-26 are sequential perspective views showing the simultaneous rotation of the mixer of FIG. 16 about two axes.
Figure 21:
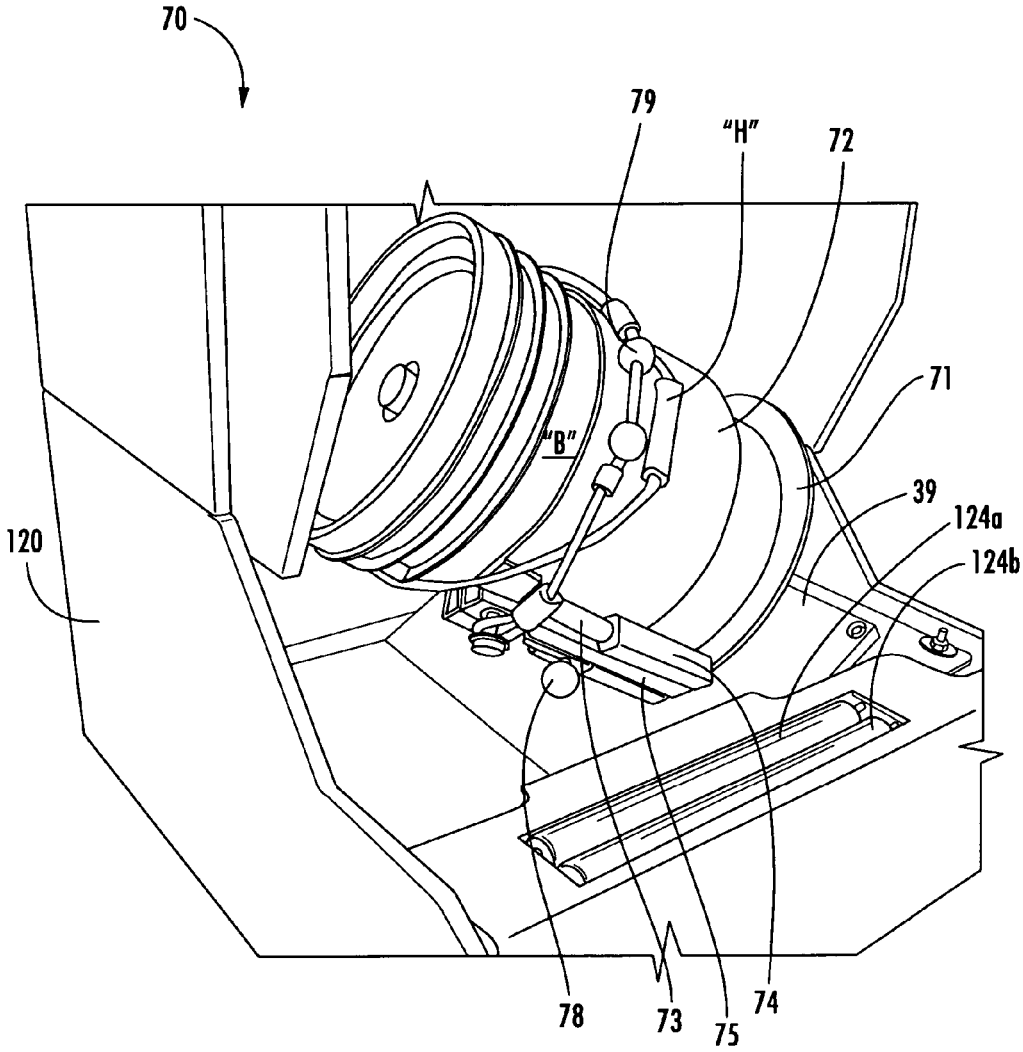
Figure 22:
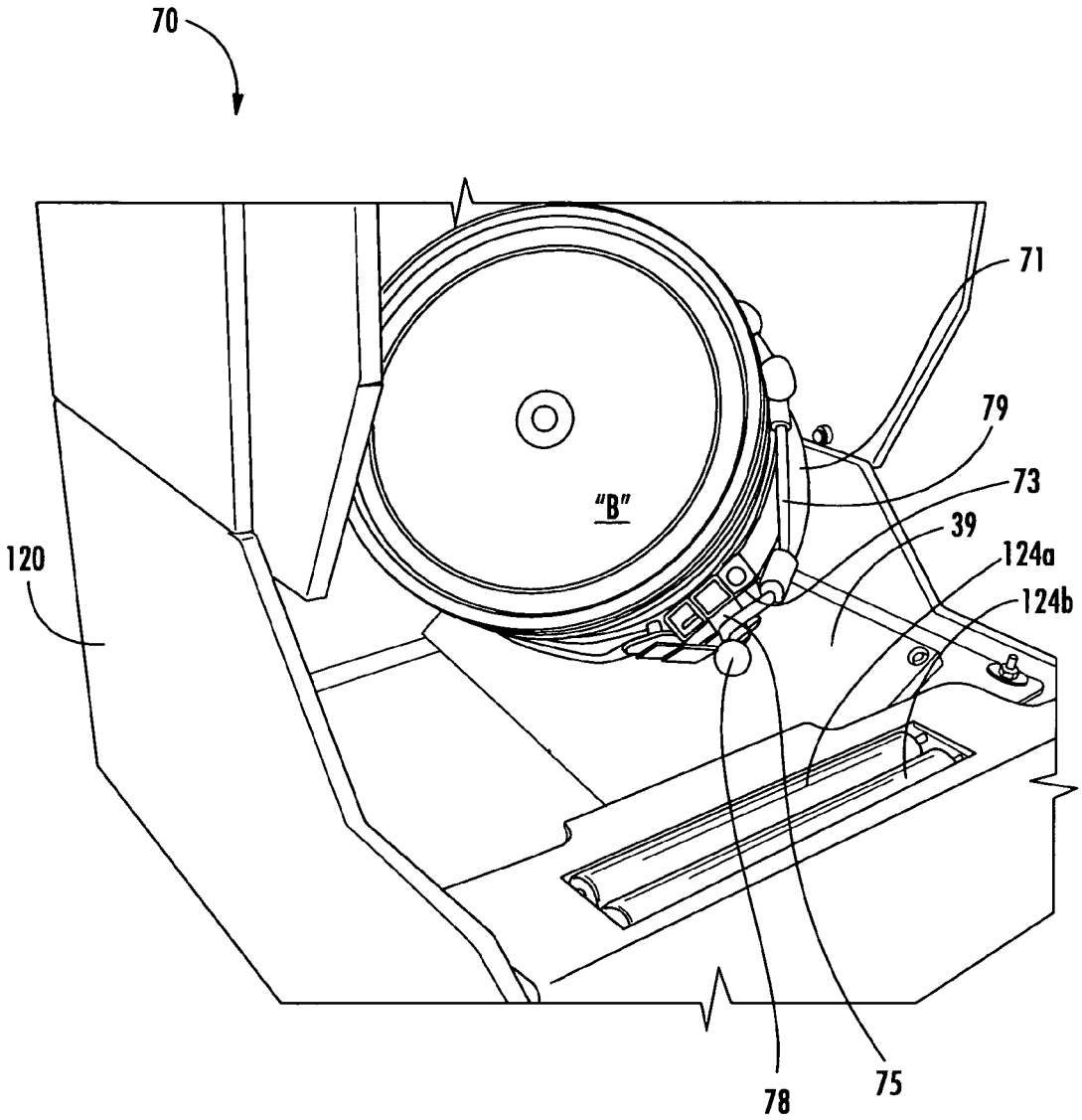
Figure 23:
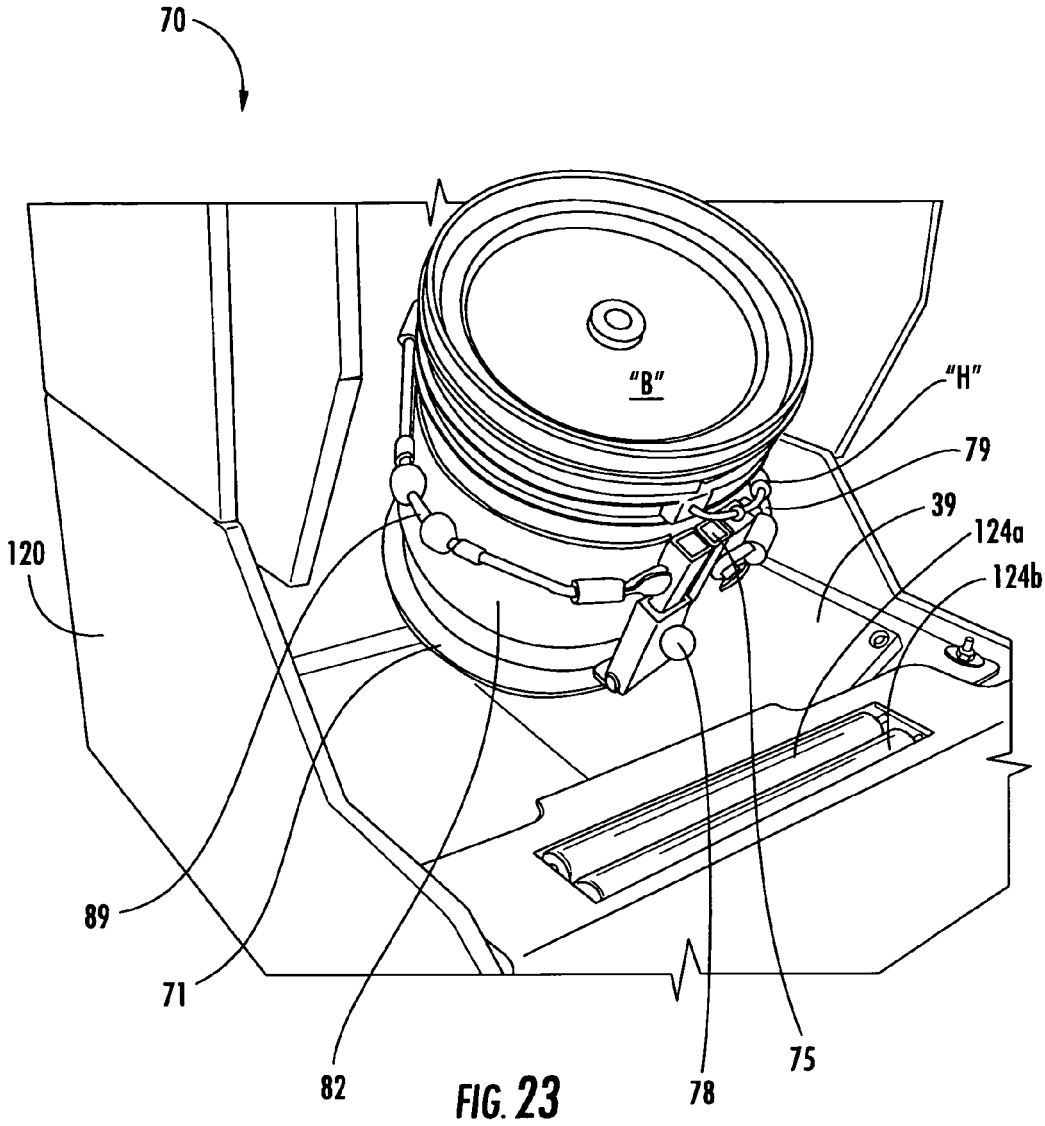
Figure 24:
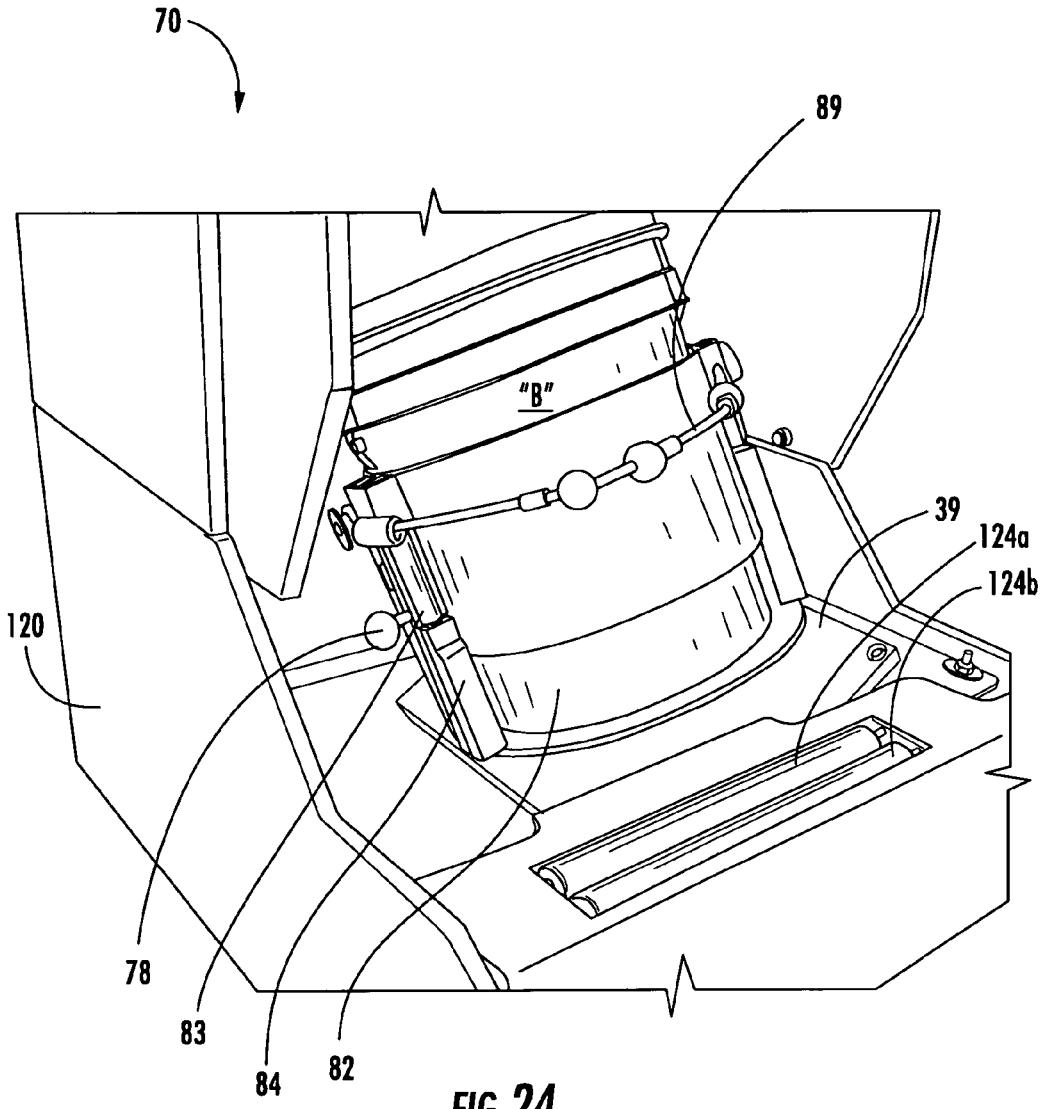
Figure 25:
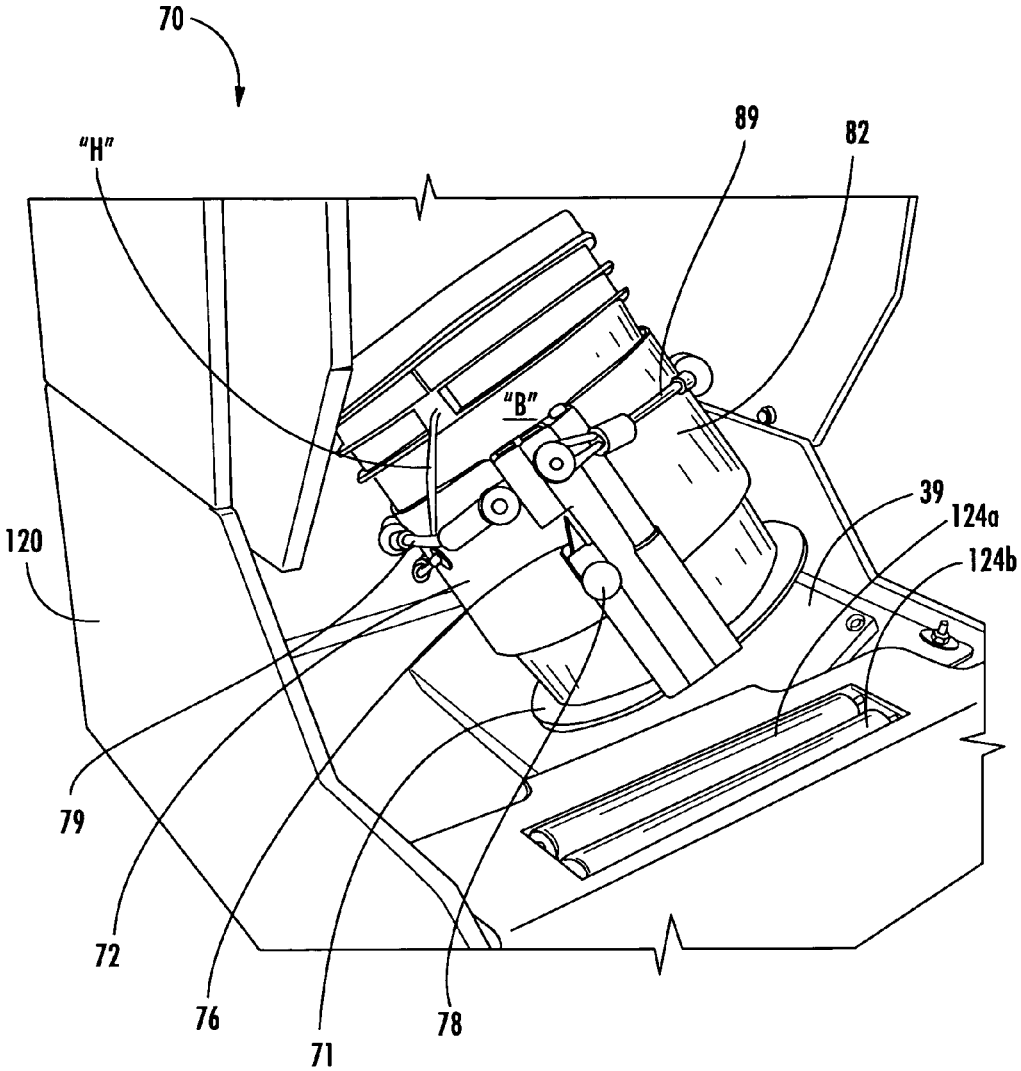
Figure 26:
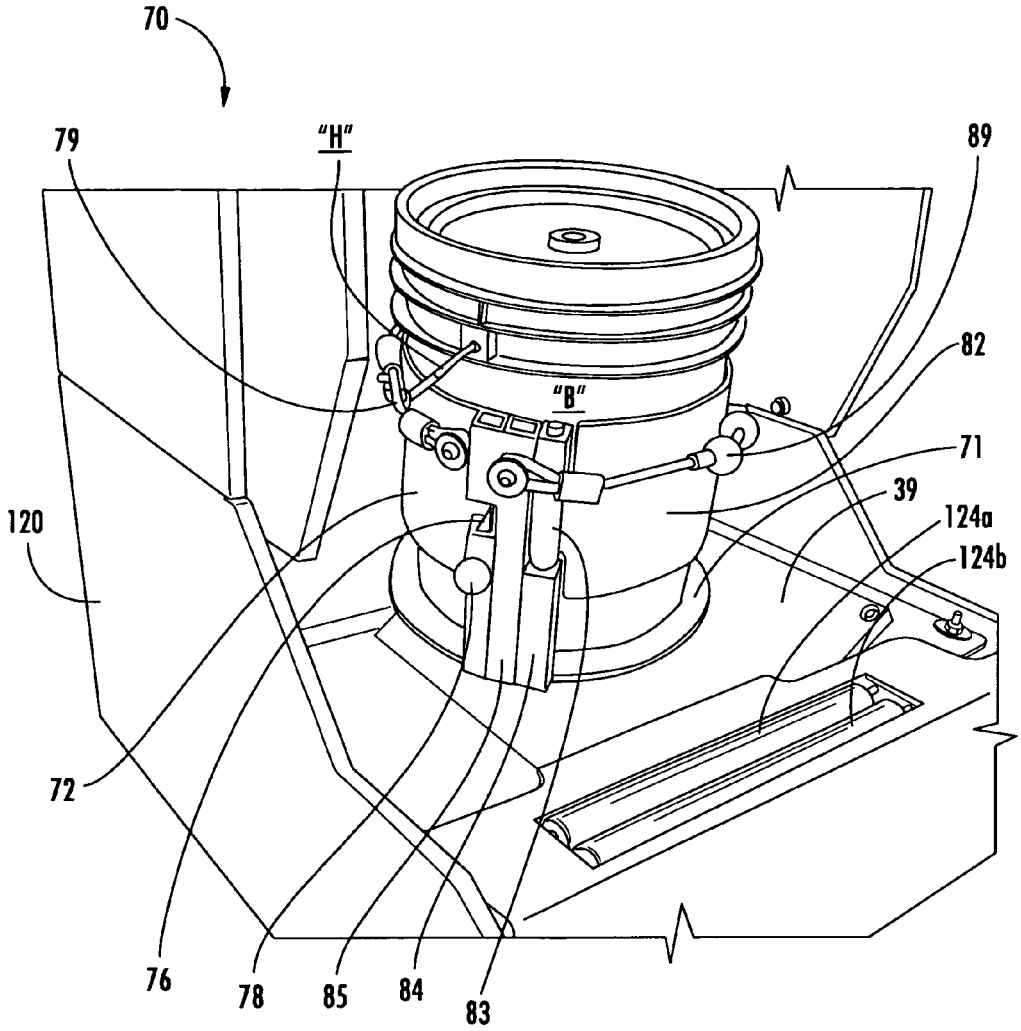

When the motor 35 stops driving the bevel gear 41, the platform 71 comes to rest at its center of gravity, which is one of the two positions shown in FIGS. 20-26. In FIG. 20, the door 72 faces a front opening of the opening of the housing 120, and in FIG. 25, the other door 82 faces the front opening of the housing 120. In both positions, the platform 71 is substantially flush with the rollers 124*a*, 124*b*, and substantially parallel with the base surface to facilitate loading and unloading of the bucket "B" onto the platform 71.

Figure 27:
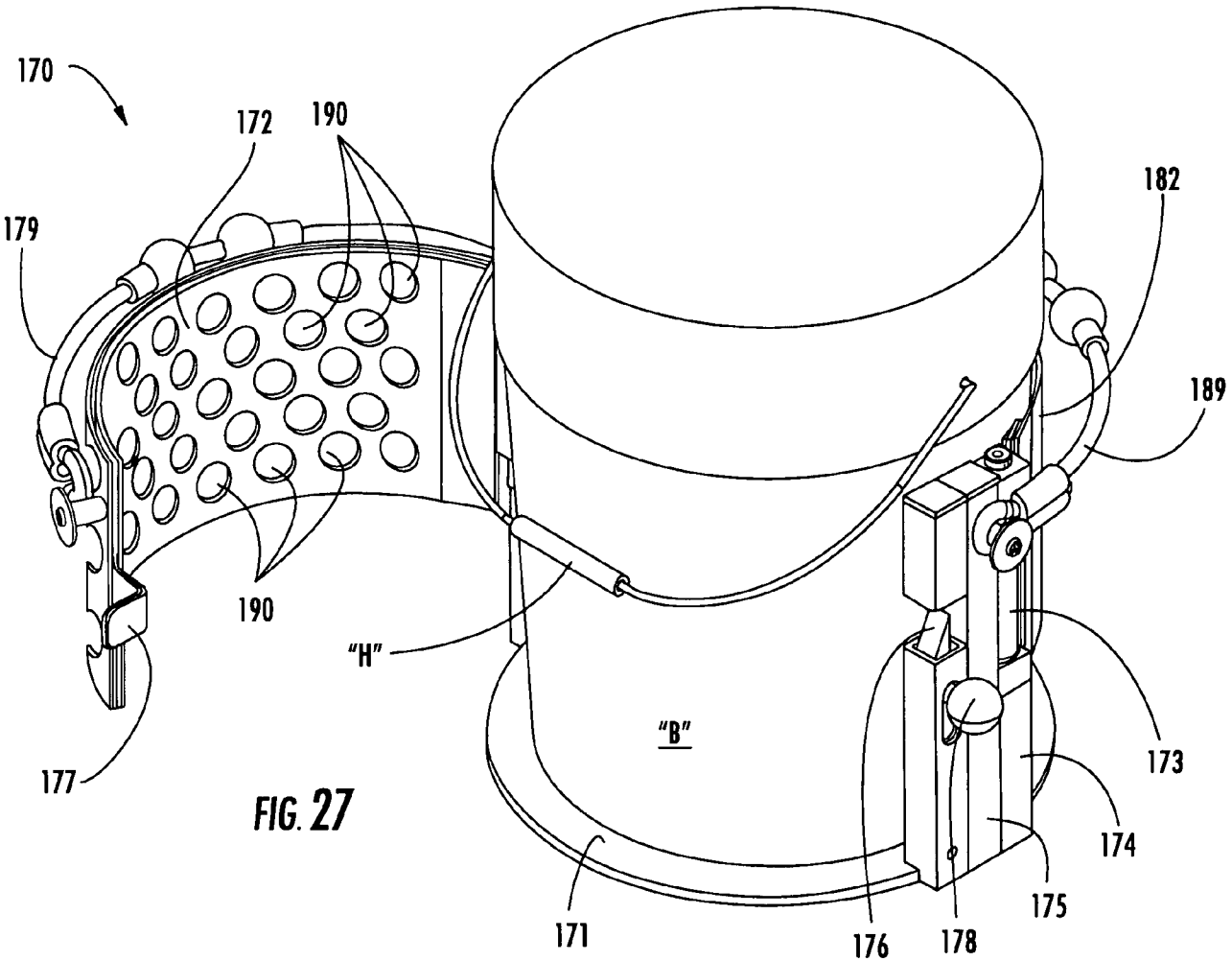
FIG. 27 is a partial perspective view of a mixer according to yet another preferred embodiment of the invention.

Yet another preferred embodiment of a mixer according to the invention is illustrated in FIG. 27. As in the previously described mixer 70, the mixer 170 includes a platform 171 for supporting a container having a material to be mixed, such as the paint bucket "B." The mixer 170 includes a holding assembly for maintaining the bucket "B" on the platform 171, such as two doors 172, 182 carried on the platform 171. The doors 172, 182 have an arcuate shape conforming to the curvature of the lateral sidewall of bucket "B". In addition, a plurality of holes 190 can be formed in the doors 172, 182 of the mixer 170. The holes 190 reduce the weight of the doors 172, 182 in comparison to the solid doors 72, 82 of the previously described mixer 70.

The mixer 170 is otherwise similar in construction to the previously described mixer 70. The doors 172, 182 of mixer 170 are mounted by respective hinges 173, 183 to posts 174, 184, respectively, that extend upwardly from the platform 71. The door 172 has a latch assembly that includes a strike plate 177 mounted at one end of the door 172 that engages and latches with a plunger 176 mounted on the platform 171. The strike plate 177 can be disengaged from the plunger 176 by pressing down on the handle 178, thereby releasing the strike plate 177 from engagement with the plunger 176 and allowing the door 172 to pivot to an open position. The other door 182 has an identical latch assembly. The mixer 170 also includes retainer cords 179, 189.

Figure 28:
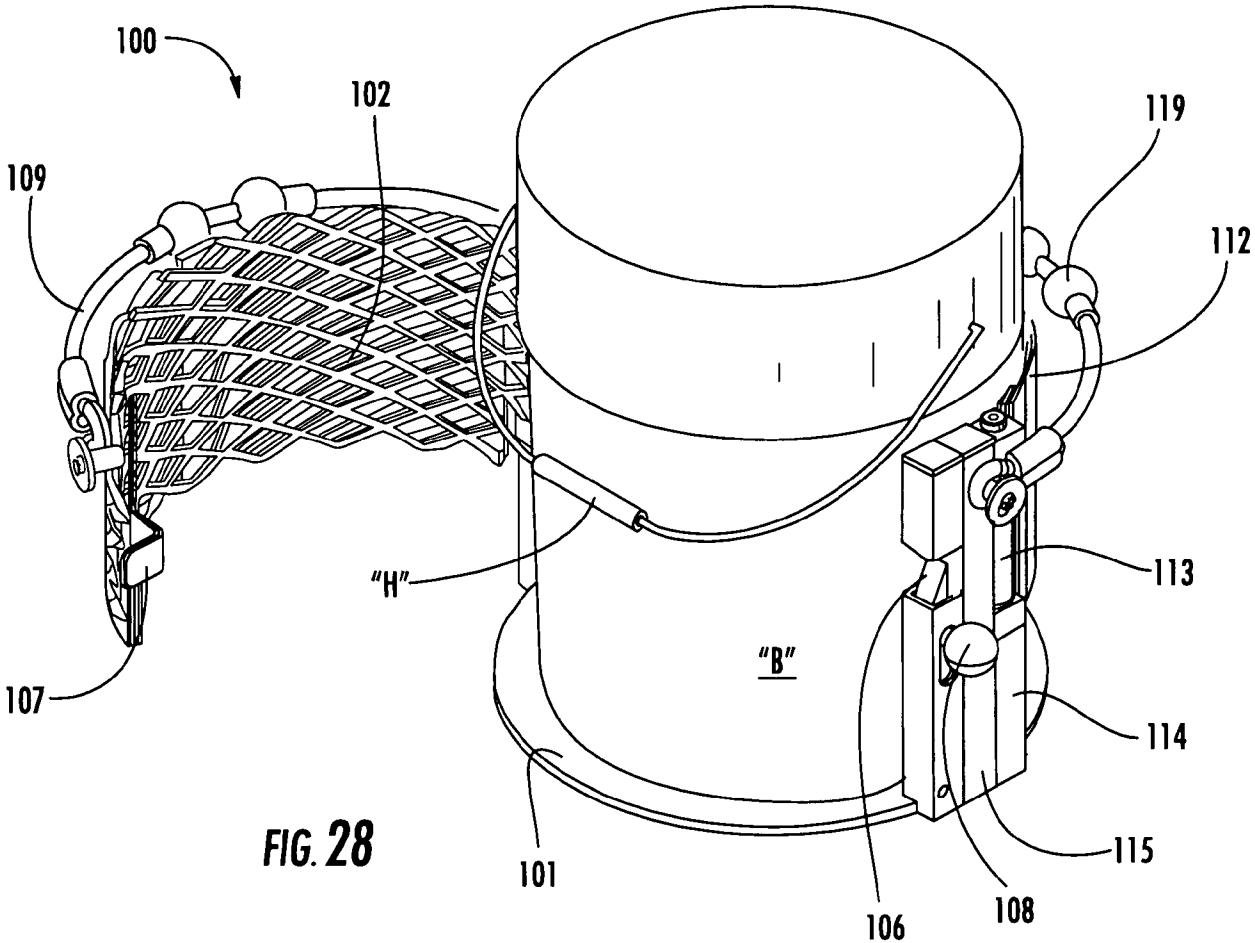
FIG. 28 is a partial perspective view of a mixer according to yet another preferred embodiment of the invention.

Yet another preferred embodiment of a mixer according to the invention is illustrated in FIGS. 28-31, and shown generally at reference numeral 100. The mixer 100 includes a platform 101 for supporting a container having a material to be mixed such as the paint bucket "B", and doors 102, 112 are carried on the platform 101. The doors 102, 112 have an arcuate shape conforming to the curvature of the bucket "B." As shown in FIG. 28, the doors 102, 112, can have a mesh structure, unlike the completely solid doors shown in the embodiments above. The doors 102, 112 can be made by providing two layers of expanded metal, stretching the metal layers to form apertures, and then overlaying the layers on one another with a one-eighth inch air gap between the two layers. The mesh construction of the doors 102, 112 provide strength while reducing the weight of the doors 102, 112 in comparison to a completely solid structure. The doors 102, 112 are mounted by respective hinges 103, 113 to posts 104, 114, respectively, that extend upwardly from the platform 101. The posts 104, 114 are preferably hollow and made of aluminum. The mixer 100 can be made of any suitable material. Preferably, all components of the mixer 100 are made of aluminum, except for the doors 102, 112, that are preferably made of expanded steel.

Figure 29:
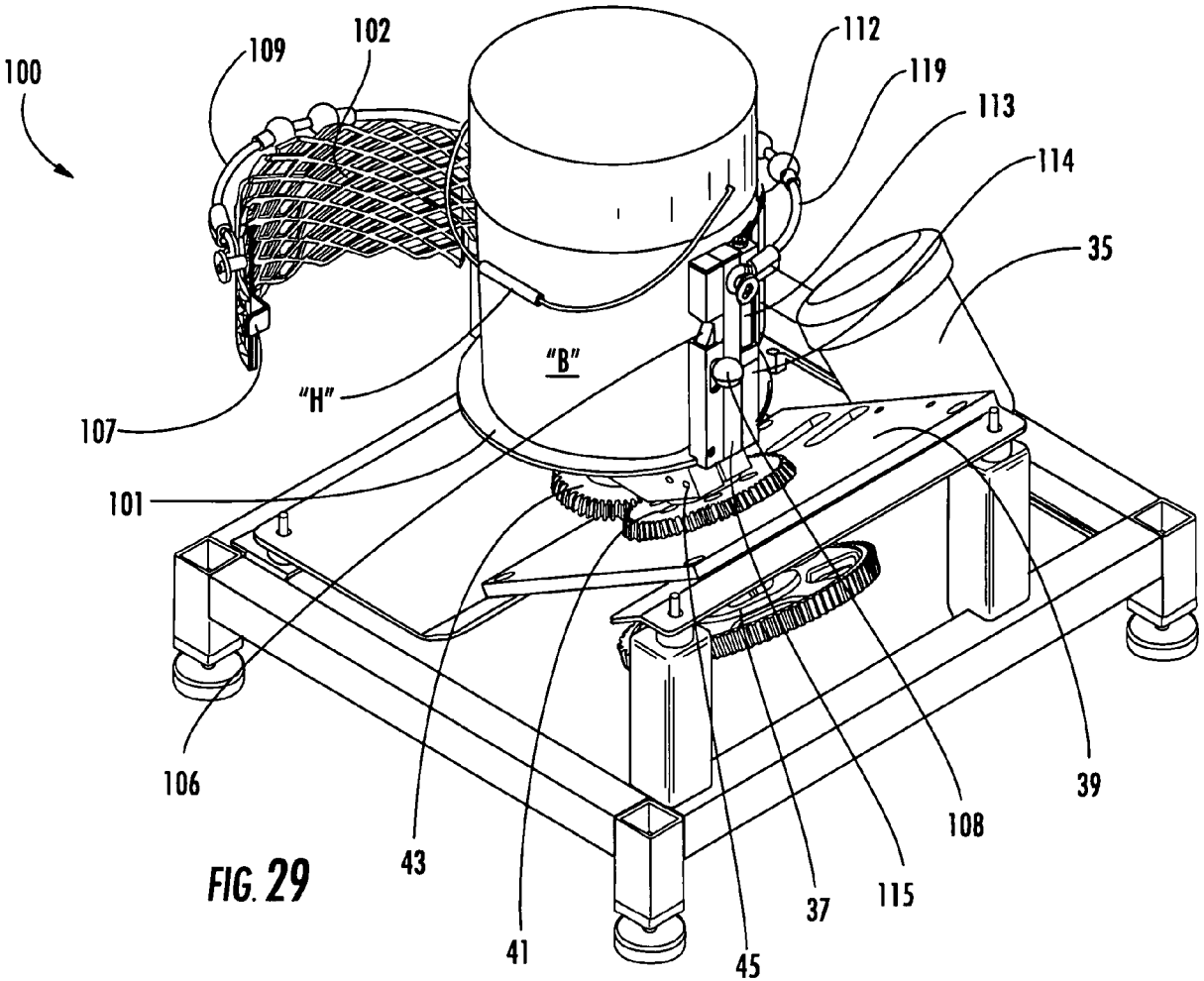
FIG. 29 is a perspective view of the mixer of FIG. 28.
Figure 30:
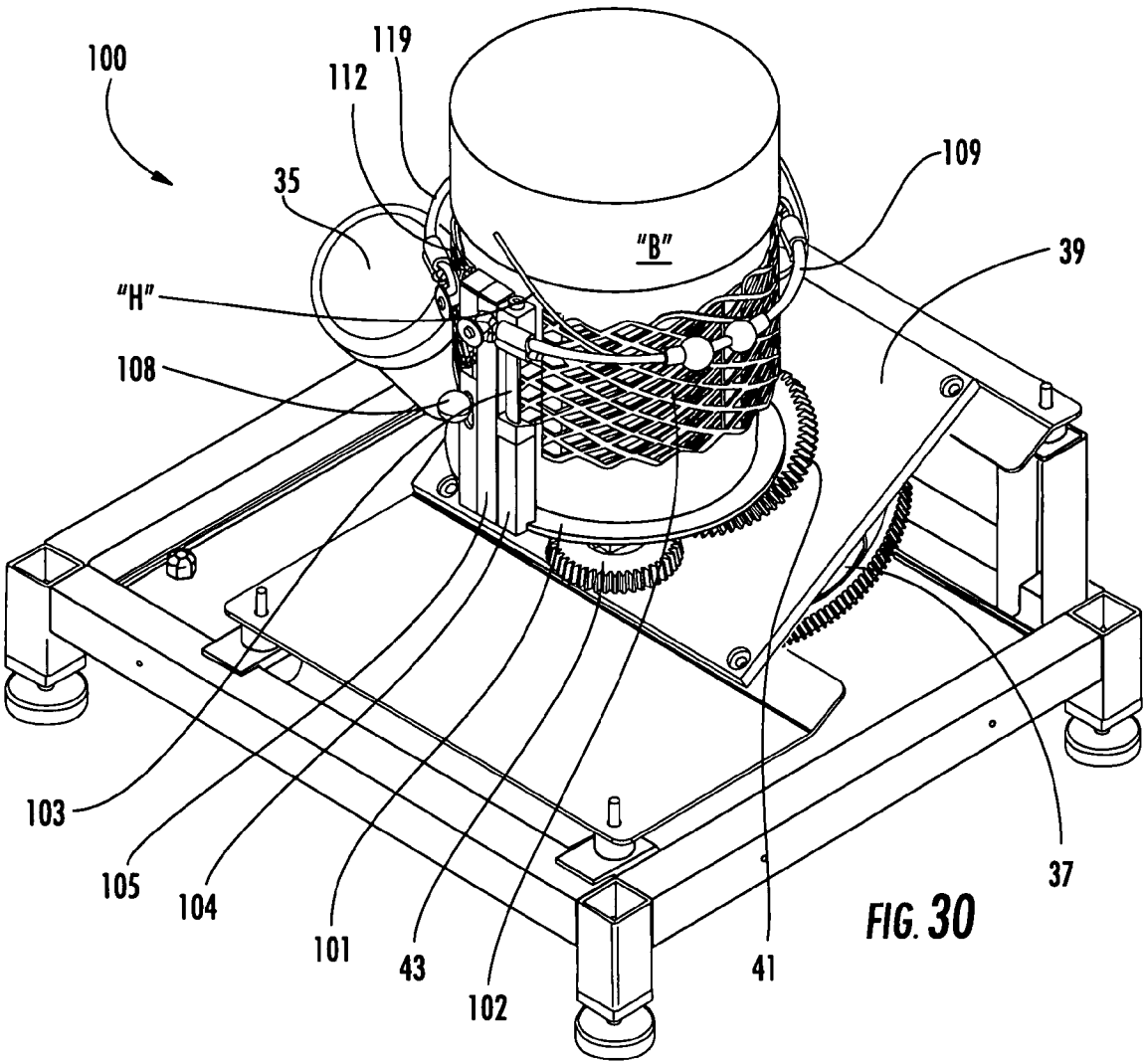
FIG. 30 is another perspective view of the mixer of FIG. 28.
Figure 31:
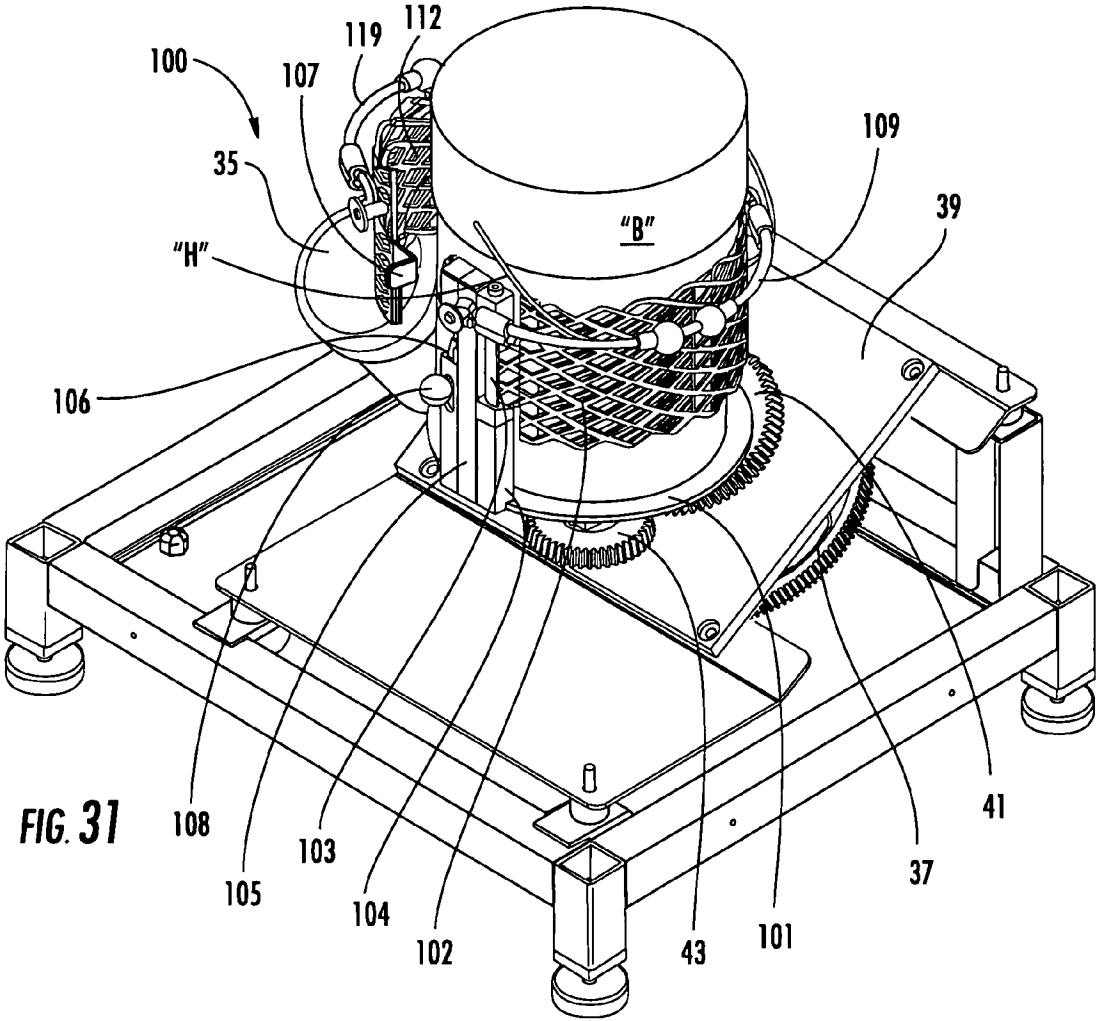
FIG. 31 is yet another perspective view of the mixer of FIG. 28.

As shown in FIG. 28, the door 102 has a latch assembly that includes a strike plate 107 mounted at one end of the door 102 that engages and latches with a plunger 106 mounted on the platform 101. When the strike plate 107 engages the plunger 106, the door 102 is locked into a closed position, as shown in FIG. 30. A latch release handle 108 communicates with the plunger 106. The strike plate 107 can be disengaged from the plunger 106 by pressing down on the handle 108, thereby releasing the strike plate 107 from engagement with the plunger 106 and allowing the door 102 to pivot to an open position, as shown in FIGS. 29 and 31. The other door 112 has an identical latch assembly.

The mixer 100 includes retainer cords 109, 119 mounted on the doors 102, 112, respectively. The retainer cords 109, 119 prevent the bucket handle "H" from flying outwardly due to centrifugal force during mixing operations. The retainer cords 109, 119 extend around the closed doors 102, 112 and the bucket handle "H". Retainer cord 109 is mounted on door 102 and a post 105 extending upward from the platform 101. Retainer cord 119 is mounted on door 112 and a post 115 extending upward from the platform 71. The posts 105, 115 are located approximately 180 degrees from each other on platform 101.

The mixer 100 is otherwise similar in construction to the previously described embodiments. As such, the mixer 100 is moved by the same actuating mechanism as is described in the previous embodiments.

Figure 32:
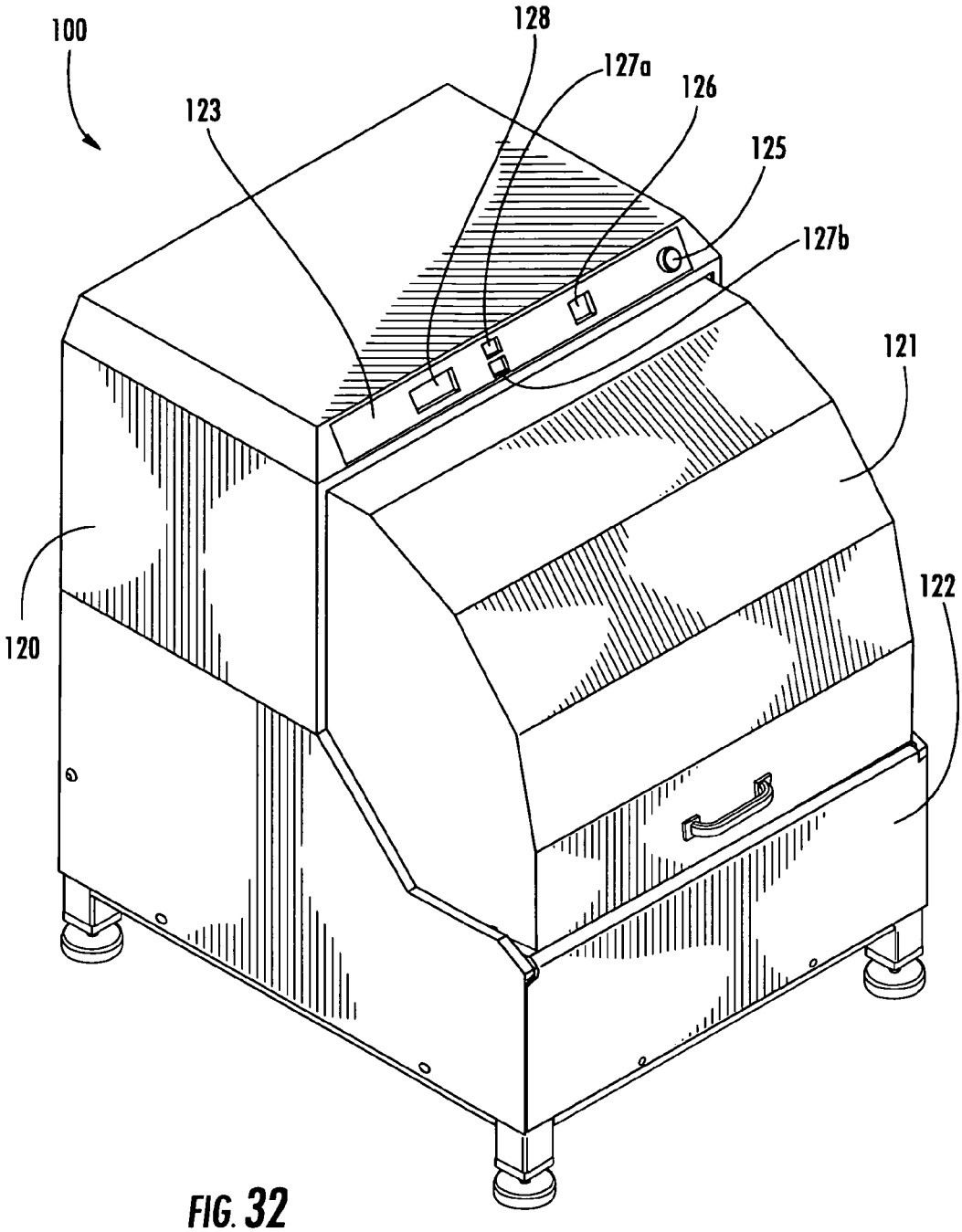
FIG. 32 is a perspective view of the mixer of FIG. 28, shown including a housing.
Figure 33:
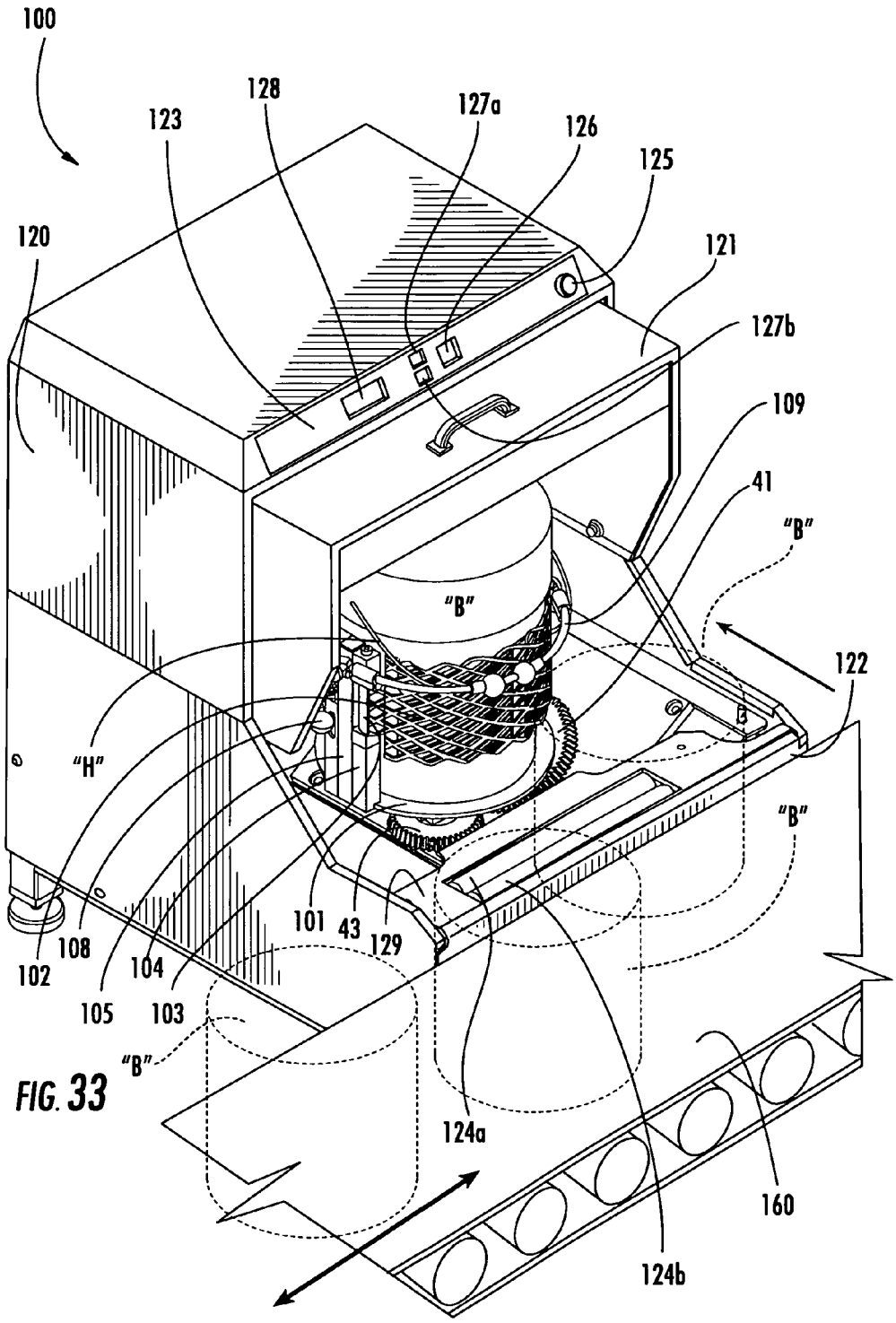
FIG. 33 is another perspective view of the mixer of FIG. 28 shown with the housing and a conveyor.

As shown in FIGS. 32 and 33, the mixer 100 can include housing 120. The housing 120 has an opening that can be covered by a sliding door 121, which provides access to the bucket "B" within the housing 120. As shown in FIG. 33, the bottom extent of the housing opening, defined by the top edge of the housing sidewall 122, resides in substantially the same horizontal plane as the platform 101 when in the loading/unloading position. As such, the bucket "B" is positioned above the sidewall 122, and can be removed without having to elevate the bucket "B" and lift it over the sidewall 122. Although the housing sidewall 122 is shown in FIG. 33 as being co-planar with the platform 101, the height of the sidewall 122 can be varied so long as it is not higher than the platform 101. As such, the sidewall 122 of the housing 120 provides a low profile access that enables the user to remove the bucket "B" without having to lift the bucket "B" over the sidewall of the housing as in the prior art apparatus shown in FIG. 1, thereby reducing the risk of the user sustaining back or other bodily injury as a result of strenuous lifting of the bucket "B".

The housing 120 can include a loading table 129 positioned above the sidewall 122. As shown in FIG. 33, the loading table occupies the same horizontal plane as the platform 101, and is substantially perpendicular to the sidewall 122. The loading table 129 can include rollers 124*a*, 124*b* positioned therein for facilitating movement of the bucket "B" over the loading table 129 and onto the platform 101. Alternatively, the loading table 129 can include a conveyor belt or ball rollers to facilitate movement of the bucket "B" over the loading table, instead of, or in addition to, the rollers 124*a*, 124*b*. Although, the loading table 129 is shown as being a part of the housing 120, the loading table 129 can be a separate structure having a surface that occupies substantially the same horizontal plane as the platform 101 and is proximate to the platform 101 so as to facilitate movement of the bucket "B" onto the platform 101.

As shown in FIG. 33, a conveyor belt 160 can be positioned proximate the loading table 129. The conveyor belt 160 occupies substantially the same horizontal plane as the loading table 129 and the platform 101, and extends perpendicularly to the rollers 124*a*, 124*b* on the loading table 129. The bucket "B" is carried by the conveyor 160 and delivered to the loading table 129 where the rollers 124*a*, 124*b* facilitate movement of the bucket "B" onto the platform 101, as shown in FIG. 33.

The interior surface of the housing door 121 can be lined with insulation to absorb the rattle of the bucket "B" during mixing operations. The insulation can be a high density flexible polyurethane foam, such as "Last-A-Foam" Durable Foam TF 507013, manufactured by General Plastics Mfg. Co. Although FIGS. 31 and 32 show the housing 120 in conjunction with mixer 100, the housing 120 may be utilized with all embodiments of the invention.

As shown in FIGS. 32 and 33, the housing 120 includes a control panel 123 having a stop button 125, information key 126, control keys 127*a*, 127*b* and display screen 128. Pressing the stop button 125 stops the supply of power to the motor 35 of the mixer 100. Pressing the information key 126 results in various information regarding the mixing operations being displayed on the display screen 128. Such information can the include number of cycles completed, average cycle length and total run time. By pressing the information key 126 all of the aforementioned data is sequentially displayed on the display screen 128 for a predetermined period of time.

Control keys 127*a*, 127*b* control the length of time of the mixing operation. The control keys 127*a*, 127*b* are operatively linked to the motor 35 and are programmed to run the mixing operation for a predetermined amount of time. For example, control key 127*a* can be programmed to run the mixing operation for three minutes, and control key 127*b* can be programmed to run the mixing operation for five minutes. As such, control key 127 can be labeled "light" as it would be selected by the user to mix light colored paints, and control key 128 can be labeled "dark" as it would be selected by the user to mix dark colored paints.

Alternatively, control key 127*a* can be programmed to incrementally add a predetermined amount of time, such as fifteen seconds, to the length of the mixing operation, and control key 127*b* can be programmed to incrementally subtract a predetermined amount of time, such as fifteen seconds, from the duration of the mixing operation. In this configuration, the information key 126 becomes the "run" key, and is programmed such that pressing the key 126 initiates the mixing operation for a predetermined amount of time, such as three minutes. Once the key 126 is pressed, mixing operations begin. The user can selectively add or subtract to the total running time of the mixing operation in increments of fifteen seconds, or other predetermined time period, by pressing the control keys 127*a*, 127*b* as desired. The control key 127*a* can be labeled with an upward arrow (Λ), and control key 127*b* can be labeled with a downward arrow (V). In this configuration, the information described above, such as number of cycles completed, average cycle length and total run time, are accessed by simultaneously pressing the control keys 127*a*, 127*b*. The data is then sequentially displayed on the display screen 128 for a predetermined period of time.

Figure 34:
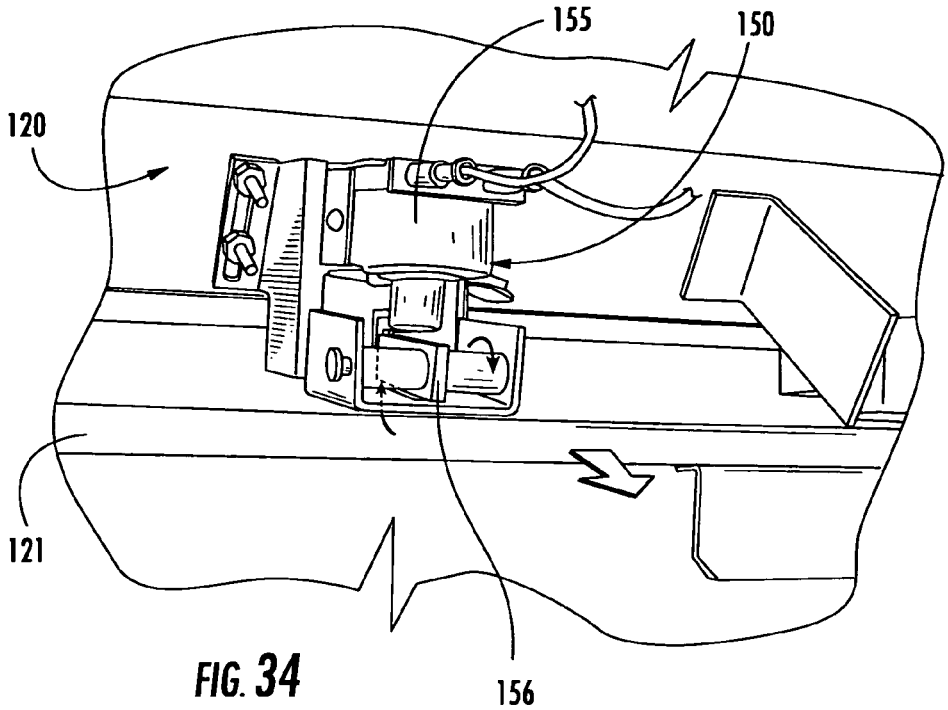
FIG. 34 is a partial rear view of the mixer of FIG. 28.
Figure 35:
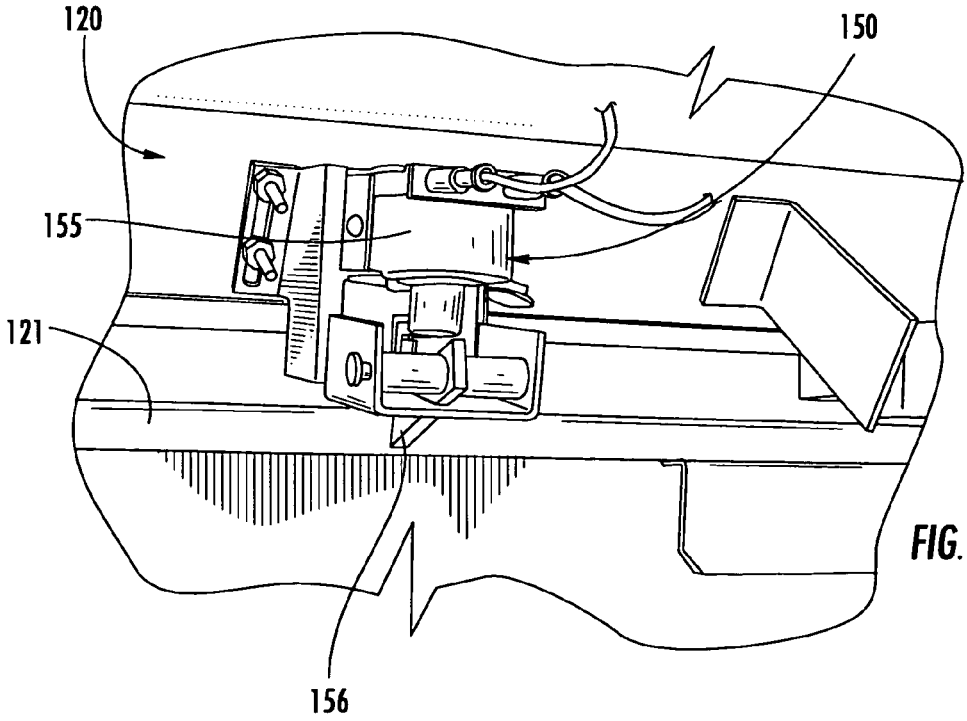
FIG. 35 is another partial rear view of the mixer of FIG. 28.
Figure 36:
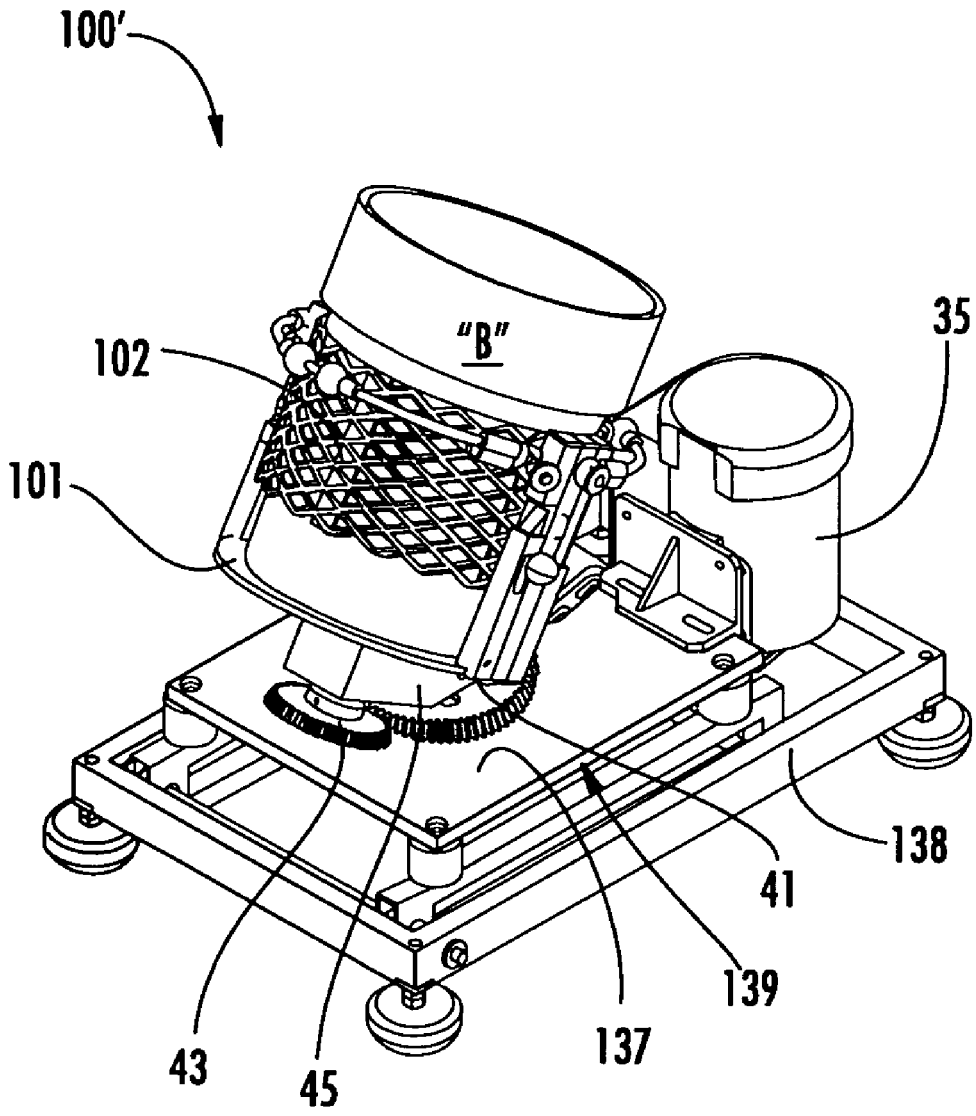
FIG. 36 is a perspective view of a mixer according to yet another preferred embodiment of the invention.

As shown in FIGS. 34 and 35, the housing 120 includes a locking mechanism 150 comprising a solenoid 155 and a plunger 156 that are connected to the power supply to the mixer 100 such that when the power is on, the solenoid 155 is energized and the plunger is retracted, as shown in FIG. 34. In this position with the plunger retracted, the housing door 121 can be opened at will by the user. When power to the mixer 100 is interrupted, the solenoid becomes unenergized and the plunger 156 is lowered, as shown in FIG. 35, thereby preventing the opening of the housing door 121.

The solenoid 155 can be connected to a timer such that when mixing operations are prematurely terminated, either by an interruption in the power supply, or by pressing the stop button 125 before completion of the mixing operation, the plunger 156 remains lowered for a predetermined amount of time, such as one minute. As such, if the currently running mixing operation is stopped before completion, the user will be prevented from opening the housing door 121 for the predetermined amount of time. This serves as a deterrent to users who may attempt to prematurely terminate a mixing cycle before completion by disrupting the power supply. For example, an employee attempting to service multiple customers in a large hardware store may be tempted to stop a mixing operation before it is complete in order to service the next customer. However, in doing so, the employee risks selling a container of paint that is not completely mixed, resulting in an ultimately dissatisfied customer. Therefore, if the employee interrupts a mixing operation by disrupting the supply of power to the mixer 100, the plunger 156 is lowered and remains lowered for the predetermined amount of time, preventing the employee from immediately accessing the paint container and thus providing a deterrent to premature termination of the mixing cycle.

Figure 37:
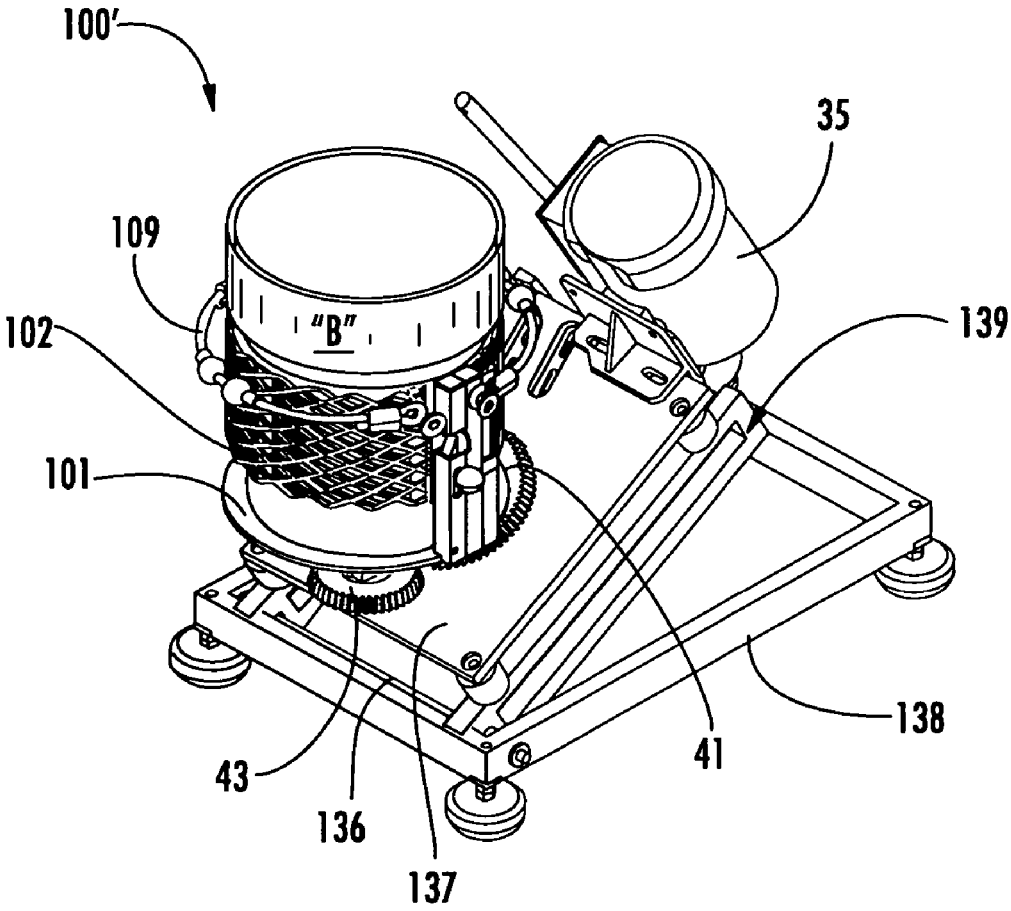
FIG. 37 is another perspective view of the mixer of FIG. 36.
Figure 38:
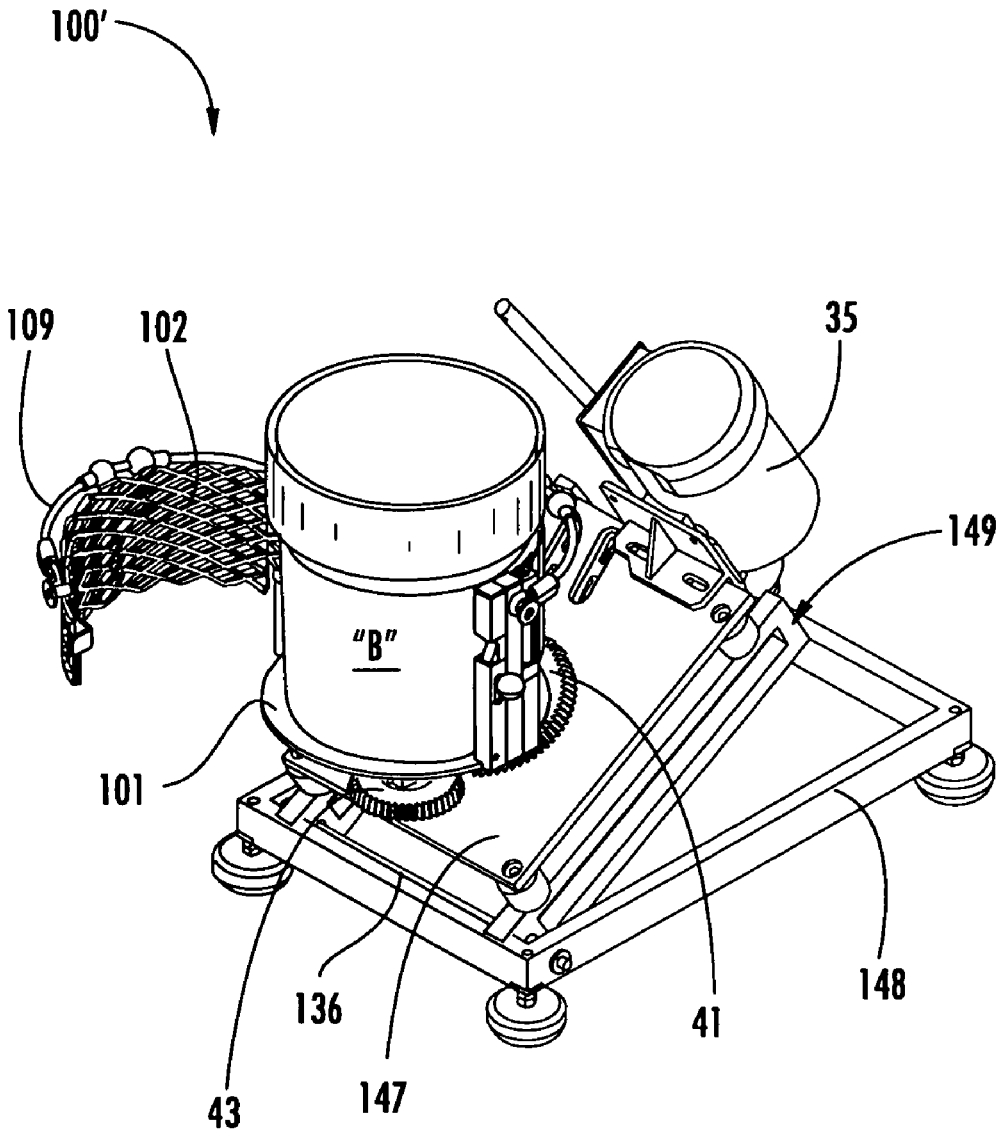
FIG. 38 is yet another perspective view of the mixer of FIG. 36.

Another preferred embodiment is illustrated in FIGS. 36-40, and shown generally at reference numeral 100'. The mixer 100' is identical to previously described mixer 100, except that it includes a support frame 139 that enables the platform 101 to be moved between a mixing position, shown in FIG. 36, and a loading/unloading position, shown in FIG. 38. The support frame 139 includes an inner frame 137 and an outer frame 138. The outer frame 138 is positioned on the ground surface and supports the inner frame 137. The outer frame 138 sits approximately parallel to the ground surface. The inner frame 137 is pivotally connected to the outer frame 138 by a pivot rod 136. The bevel gear 41 is mounted on the top side of the inner frame 137. The mixer 100' includes a dedicated actuator, such as a gear motor, for moving the inner frame 137 about the pivot rod 136. As such, the inner frame 137 is movable between the mixing position, shown in FIG. 36, in which the inner frame is parallel to the outer frame 138 and the platform 101 is angled, and the loading/unloading position, shown in FIG. 38, in which the inner frame 137 is elevated and inclined to the outer frame 138 and the platform 101 is parallel to the ground surface. When in the loading/unloading position, the door 102 is opened, as shown in FIG. 38, to allow for the loading or unloading of the bucket "B" onto the platform 101. Once the bucket "B" has been placed onto the platform 101, the door is closed, as shown in FIG. 37, and the inner frame 137 can be lowered to the mixing position, shown in FIG. 36. The mixer 100' is otherwise similar to mixer 100 described above.

Figure 39:
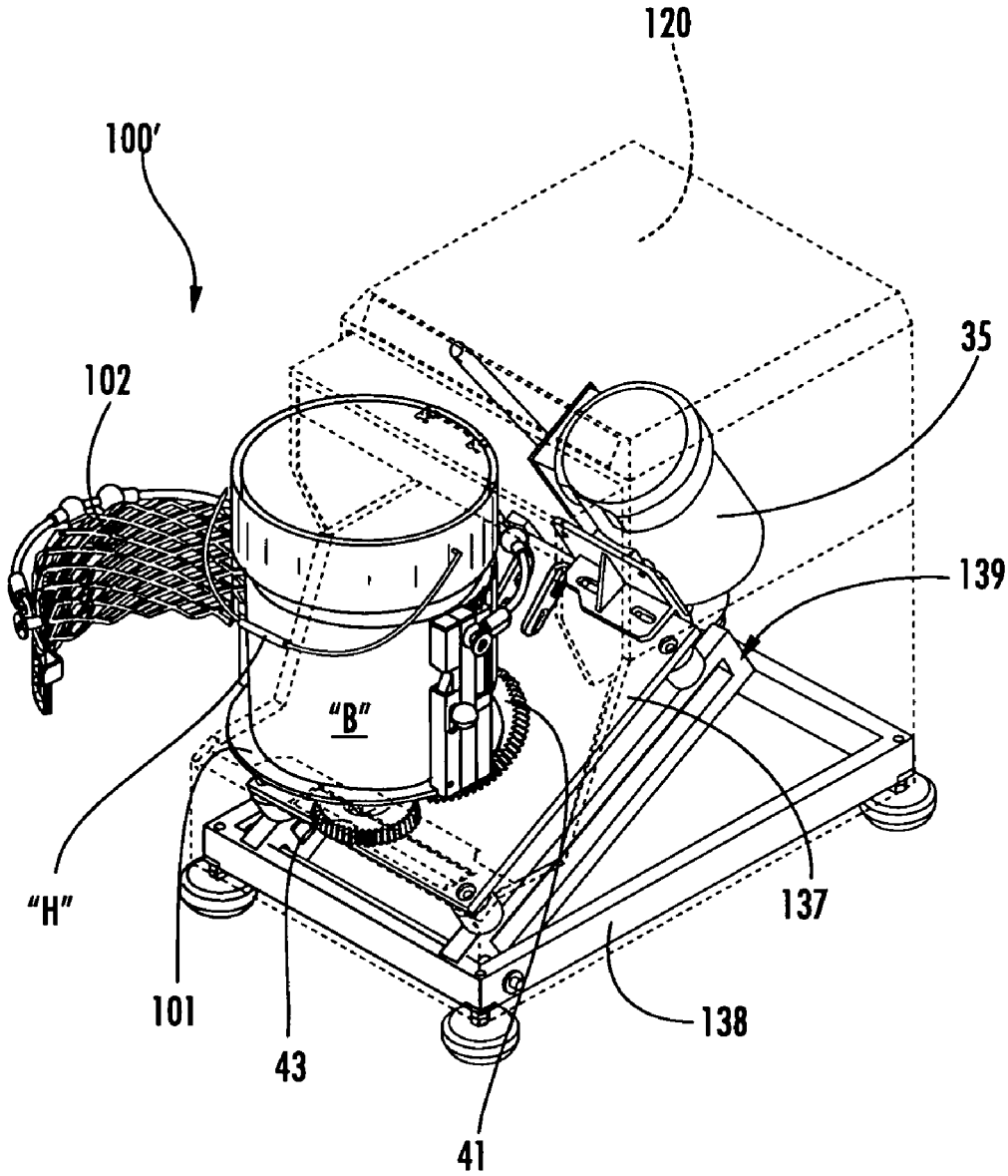
FIG. 39 is another perspective view of the mixer of FIG. 36, shown including a housing.
Figure 40:
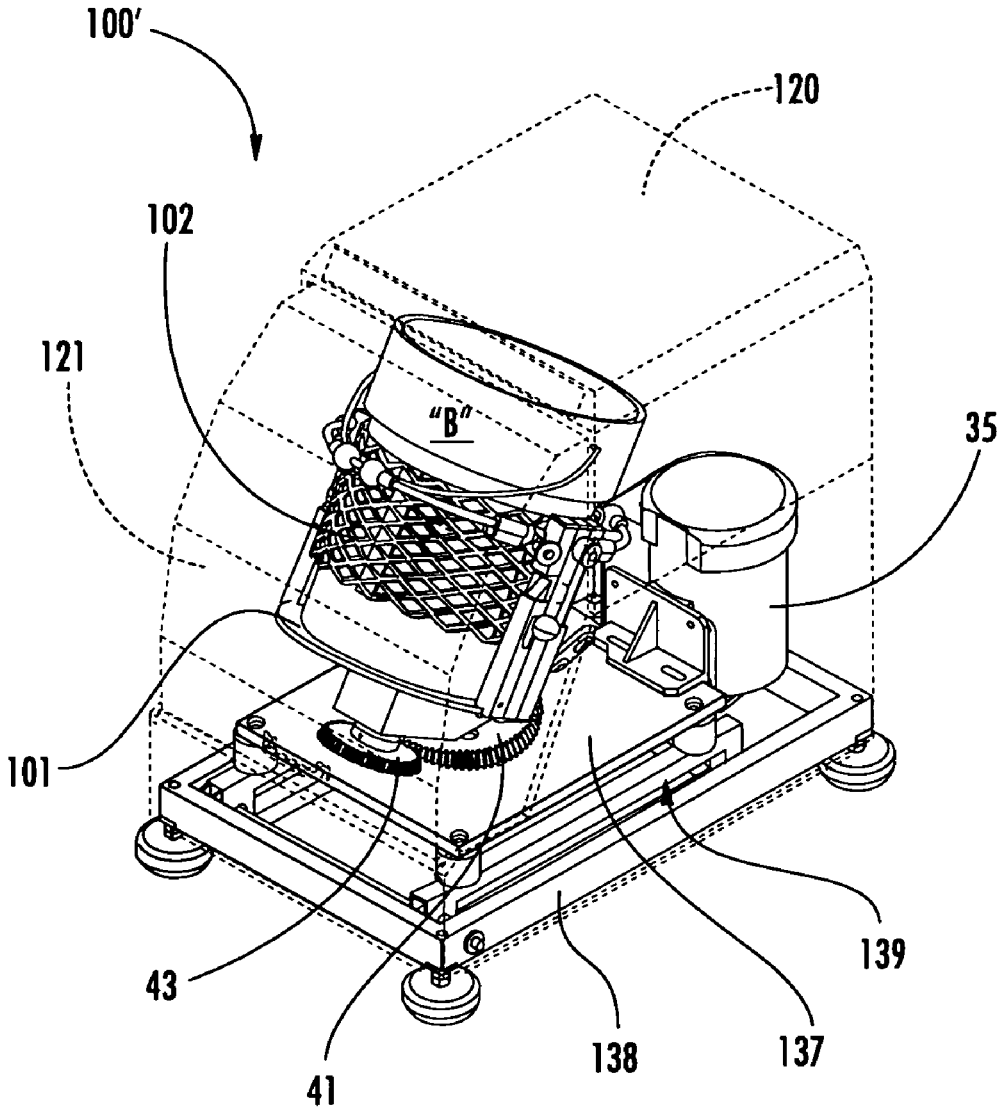
FIG. 40 is yet another perspective view of the mixer of FIG. 36 shown with the housing.

As shown in FIGS. 39 and 40, the mixer 100' is contained within housing 120. The housing door 121 can be operatively connected to the actuator of the support frame 139 so that when the housing door 121 is opened, the inner frame 137 is positioned in the loading/unloading position, shown in FIG. 39. In this position, the door 102 is opened and the platform 101 is positioned at the opening of the housing 120. Door 102 is opened, and the user can place the bucket "B" onto the platform 101 without having to bend over or reach into the housing 120. Once the bucket "B" has been placed onto the platform 101, the door 102 is closed, and the housing door 121 is closed. The housing door 121 is operatively connected to the support frame 139 so that closure of the housing door 121 causes the inner frame 137 to be lowered to the mixing position, shown in FIG. 40. The platform 101 is then rotated about two axes as described above to mix the contents of the bucket "B". Once the mixing operation on the bucket "B" is complete, the housing door 121 is opened. Opening of the housing door 121 actuates the support frame 139 again and the inner frame 137 is elevated back to the loading/unloading position, shown in FIG. 39. Door 102 is then opened again so that the bucket "B" can be removed from the platform 101.

An ergonomic mixer is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A mixing apparatus comprising:

(a) a rotation assembly including a gear-driven rotatable platform for supporting a container, and a gear network including a gear support angled from horizontal, a bevel gear rotatably mounted to an upper surface of the support, a pivot coupled in rotation with and mounted concentrically with the bevel gear and eccentric to a vertical axis of the platform, and a beveled platform gear concentric and in axial alignment with the vertical axis of the platform and mated with the bevel gear;

(b) a motor for driving the rotation of the bevel gear; and (c) a container holding assembly having a vertical extent, carried by the platform and moveable between a closed position wherein the holding assembly is positioned proximate the container to retain the container on the platform during movement of the platform, and an open position wherein the holding assembly is positioned away from the container whereby the container can be removed from the platform without lifting the container over the vertical extent of the holding assembly;

wherein the platform is mounted for movement at an angle from vertical to rotate the container about a non-vertical rotational axis while simultaneously rotating the container about a vertical axis in an orbital motion to achieve a non-tumbling, vortex mixing;

wherein rotation of the bevel gear drives the platform gear and the pivot causing the platform to which the pivot is mounted to rotate simultaneously about two axes, one vertical, and one at an angle to vertical.

2. A mixing apparatus according to claim 1, wherein the container is cylindrical and includes a lateral sidewall and at least one longitudinal end wall, the end wall for being positioned on the platform, and further wherein the holding assembly comprises an arcuate member conforming to the lateral sidewall of the container when in the closed position.

3. A mixing apparatus according to claim 2, further comprising a retainer for maintaining a handle on the container against the lateral sidewall of the container during movement of the container.

4. A mixing apparatus according to claim 1, further comprising a housing containing the platform and the holding assembly.

5. A mixing apparatus according to claim 4, wherein the housing includes an opening for accessing the container positioned on the platform and a door for selectively covering the opening.

6. A mixing apparatus according to claim 5, wherein the housing further includes a door lock for preventing opening of the housing door, the door lock operatively connected to a solenoid whereby the door lock is activated and prevents opening of the housing door when power to the mixing apparatus is disrupted.

7. A mixing apparatus according to claim 1, further comprising a loading table positioned substantially in the same horizontal plane as the platform whereby the container can be moved from the loading table to the platform without lifting the container.

8. A mixing apparatus according to claim 7, wherein the loading table includes at least one roller for facilitating movement of the container on the loading table.

9. A mixing apparatus according to claim 7, further comprising a conveyor positioned substantially on the same horizontal plane as the loading table for delivering the container to the loading table.

10. A mixing apparatus according to claim 7, further comprising a housing containing the platform and holding assembly, and wherein the housing includes the loading table.

11. A mixing apparatus according to claim 1, wherein the holding assembly comprises a first door pivotally connected to a first connecting member mounted on the platform.

12. A mixing apparatus according to claim 11, further comprising a locking assembly carried on the platform for engaging the first door when in the closed position whereby the first door is maintained in a position proximate the container.

13. A mixing apparatus according to claim 11, further comprising a locking assembly for maintaining the first door in a position proximate the container during movement of the platform, the locking assembly comprising:

(a) a first locking element carried on the first door; and (b) a complementary second locking element carried on the platform for mating with the first locking element, whereby the first locking element engages the second locking element when the door assembly is in the closed position.

14. A mixing apparatus according to claim 13, wherein the locking assembly further comprises a release for disengaging the first locking element and the second locking element.

15. A mixing apparatus according to claim 13, wherein the first locking element comprises a tapered plunger, and the second locking element comprises a strike plate, wherein the plunger latches with the strike plate when the door assembly is in the closed position.

16. A mixing apparatus according to claim 13, wherein the first locking element comprises a strike plate, and the second locking element comprises a tapered plunger, wherein the plunger latches with the strike plate when the door assembly is in the closed position.

17. A mixing apparatus according to claim 11, wherein the holding assembly further comprises a second door pivotally connected to a second connecting member mounted on the platform.

18. A mixing apparatus according to claim 17, further comprising:

(a) a first locking element carried on the first door; and (b) a complementary second locking element carried on the second door for mating with the first locking element to lock the first door and the second door together, whereby the first door and the second door are maintained in a position proximate the container when in the closed position.

19. A mixing apparatus according to claim 18, wherein the first locking element comprises a tapered plunger, and the second locking element comprises a strike plate, wherein the plunger latches with the strike plate to lock the first door and the second door together.

20. A mixing apparatus according to claim 1, further comprising a support frame for positioning on a base surface and supporting the platform, the support frame moveable from a mixing position wherein the platform is substantially non-parallel to the base surface, and a loading position wherein the platform is elevated from the mixing position and substantially parallel to the base surface.

21. A mixing apparatus according to claim 20, wherein the platform is positioned at about a thirty degree angle relative to the base surface when in the mixing position.

22. A mixing apparatus according to claim 20, wherein the support frame comprises:

(a) an outer frame for positioning on the base surface; and (b) an inner frame supporting the platform and pivotally mounted on the outer frame, wherein the inner frame sits parallel to the outer frame when in the mixing position, and is elevated at an incline to the outer frame when in the loading position.

23. A mixing apparatus according to claim 20, further comprising a housing containing the platform, holding assembly and support frame, the housing having an opening for accessing the container positioned on the platform.

24. A mixing apparatus according to claim 23, wherein the housing includes a door for opening and closing the opening, the door operatively associated with the support frame whereby the support frame moves to the loading position when the door is opened and moves to the mixing position when the door is closed.

25. A mixing apparatus according to claim 24, wherein the housing includes a locking mechanism operatively connected to a power supply for the mixing apparatus whereby the locking mechanism prevents opening of the housing door when the power supply is disrupted.

26. A mixing apparatus comprising:

a rotation assembly including a rotatable platform for supporting a container, and a gear network including a gear support angled from horizontal, a bevel gear rotatably mounted to an upper surface of the support, a pivot coupled in rotation with and mounted concentrically with the bevel gear and eccentric to a vertical axis of the platform, and a beveled platform gear concentric and in axial alignment with the vertical axis of the platform and mated with the bevel gear;

a container holding assembly including a vertical extent extending vertically upwardly from the platform and having at least one latchable door for maintaining a container on the platform during mixing; and a driving motor for driving the rotation of the bevel gear;

wherein the platform is mounted for movement at an angle from vertical to rotate the container about a non-vertical rotational axis while simultaneously rotating the container about a vertical axis in an orbital motion; and wherein rotation of the bevel gear drives the platform gear and the pivot causing the platform to which the pivot is mounted to rotate simultaneously about two axes, one vertical, and one at an angle to vertical.

27. A mixing apparatus according to claim 26, further comprising a housing defining a base surface for facilitating loading and unloading the container from the platform, the base surface positioned substantially flush and in the same horizontal plane with the platform when the platform is in the generally horizontal position.

28. A mixing apparatus according to claim 27, further comprising at least one roller supported in the base surface and positioned substantially flush therewith.

* * * * *